US011358398B2

(12) United States Patent
Nakanishi et al.

(10) Patent No.: US 11,358,398 B2
(45) Date of Patent: Jun. 14, 2022

(54) PRINT CONTROL DEVICE, NON-TRANSITORY COMPUTER-READABLE STORAGE MEDIUM STORING PRINT CONTROL PROGRAM, AND PRINTED MATTER PRODUCTION METHOD

(71) Applicant: SEIKO EPSON CORPORATION, Tokyo (JP)

(72) Inventors: Hiroaki Nakanishi, Nagano (JP); Ikuo Masujima, Asahi-mura (JP); Kiyokazu Kamijo, Nagano (JP); Kei Miyazawa, Nagano (JP); Takahiro Otani, Nagano (JP); Junko Yamamoto, Nagano (JP); Takeshi Aoki, Nagano (JP); Akinobu Miyasaka, Yamagata-mura (JP); Shiori Naruse, Tokyo (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/914,504

(22) Filed: Jun. 29, 2020

(65) Prior Publication Data

US 2021/0001643 A1 Jan. 7, 2021

(30) Foreign Application Priority Data

Jul. 1, 2019 (JP) ..... JP2019-122785

(51) Int. Cl.
*B41J 3/36* (2006.01)
*B41J 3/28* (2006.01)
(Continued)

(52) U.S. Cl.
CPC . *B41J 3/46* (2013.01); *B41J 3/28* (2013.01); *B41J 3/36* (2013.01); *B41J 3/445* (2013.01)

(58) Field of Classification Search
CPC ..... B41J 3/36; B41J 3/28; B41J 3/445; B41J 3/46
See application file for complete search history.

(56) References Cited

U.S. PATENT DOCUMENTS 9,908,353 B2 3/2018 Nakahara
2014/0063084 A1 3/2014 Yamasaki
(Continued)

FOREIGN PATENT DOCUMENTS

CN 103660610 A 3/2014
CN 106976320 A 7/2017
(Continued)

*Primary Examiner* — Matthew Luu
*Assistant Examiner* — Kendrick X Liu
(74) *Attorney, Agent, or Firm* — Global IP Counselors, LLP

(57) ABSTRACT

There is provided a print control device that causes a printing device to perform printing, the print control device including: a specifying section that specifies a print target from a captured image captured by an image capturing sensor; a display section that displays, on a display, a screen in which a trimmed image is superimposed on the captured image, the trimmed image being obtained by trimming a preview image of original print data in accordance with the print target; a setting receiving section that receives a setting of a relative position of the preview image with respect to the print target; a print instruction receiving section that receives a print instruction at the relative position; and a control section that causes the printing device to perform printing on the print target based on the original print data and the relative position according to the print instruction.

9 Claims, 24 Drawing Sheets

(51) Int. Cl.
*B41J 3/44* (2006.01)
*B41J 3/46* (2006.01)

(56) References Cited

U.S. PATENT DOCUMENTS

| | | | | |
|---|---|---|---|---|
| 2016/0088917 | A1* | 3/2016 | Nagao | G06K 9/46 132/200 |
| 2020/0314260 | A1* | 10/2020 | Inoue | H04N 1/00442 |

FOREIGN PATENT DOCUMENTS

| | | | |
|---|---|---|---|
| CN | 109572239 | A | 4/2019 |
| JP | 2017-010271 | A | 1/2017 |
| JP | 2017-149126 | A | 8/2017 |
| JP | 2017-170807 | A | 9/2017 |
| JP | 2017-170808 | A | 9/2017 |

* cited by examiner $$SZ\ 1 = 2L\ tan\left(\frac{\theta 1}{2}\right)$$

$$SZ\ 0 = \frac{NU\ 0}{NU\ 1} \cdot SZ\ 1$$

$$SZ\ 2 = \frac{SZ\ 0}{cos\,\theta 2}$$

PRINT CONTROL DEVICE, NON-TRANSITORY COMPUTER-READABLE STORAGE MEDIUM STORING PRINT CONTROL PROGRAM, AND PRINTED MATTER PRODUCTION METHOD

The present application is based on, and claims priority from JP Application Serial Number 2019-122785, filed Jul. 1, 2019, the disclosure of which is hereby incorporated by reference herein in its ultimately.

BACKGROUND

1. Technical Field

The present disclosure relates to a print control device, a print control program, and a printed matter production method for causing a printing device to perform printing.

2. Related Art

A manual scanning type printer without a paper transport system has been proposed. An information processing apparatus disclosed in JP-A-2017-010271 simultaneously captures images of a handheld printer and a print medium such that the handheld printer can detect a position on the print medium. The information processing apparatus detects the handheld printer and the print medium from captured image data obtained by capturing the handheld printer and the print medium, determines a position of the handheld printer with respect to the print medium, and transmits the position of the handheld printer to the handheld printer.

When an image to be printed is larger than the print medium, the information processing apparatus reduces the image such that the image falls within a range of the print medium.

In the information processing apparatus, unless the print medium and the image have a similar shape, an unprinted area remains around the image printed on the print medium. For this reason, it is desired to realize more desired printing, such as printing an image on the entire surface of a print medium having a different shape.

SUMMARY

According to an aspect of the present disclosure, there is provided a print control device that causes a printing device to perform printing, the print control device including: a specifying section that specifies a print target from a captured image captured by an image capturing sensor; a display section that displays, on a display, a screen in which a trimmed image is superimposed on the captured image, the trimmed image being obtained by trimming a preview image of original print data in accordance with the print target; a setting receiving section that receives a setting of a relative position of the preview image with respect to the print target; a print instruction receiving section that receives a print instruction at the relative position; and a control section that causes the printing device to perform printing on the print target based on print data according to the print instruction, the print data being obtained based on the original print data and the relative position.

According to another aspect of the present disclosure, there is provided a non-transitory computer-readable storage medium storing a print control program causing a computer to realize functions corresponding to each section of the print control device.

According to still another aspect of the present disclosure, there is provided a printed matter production method including steps corresponding to each section of the print control device.

DESCRIPTION OF EXEMPLARY EMBODIMENTS

Figure 1:
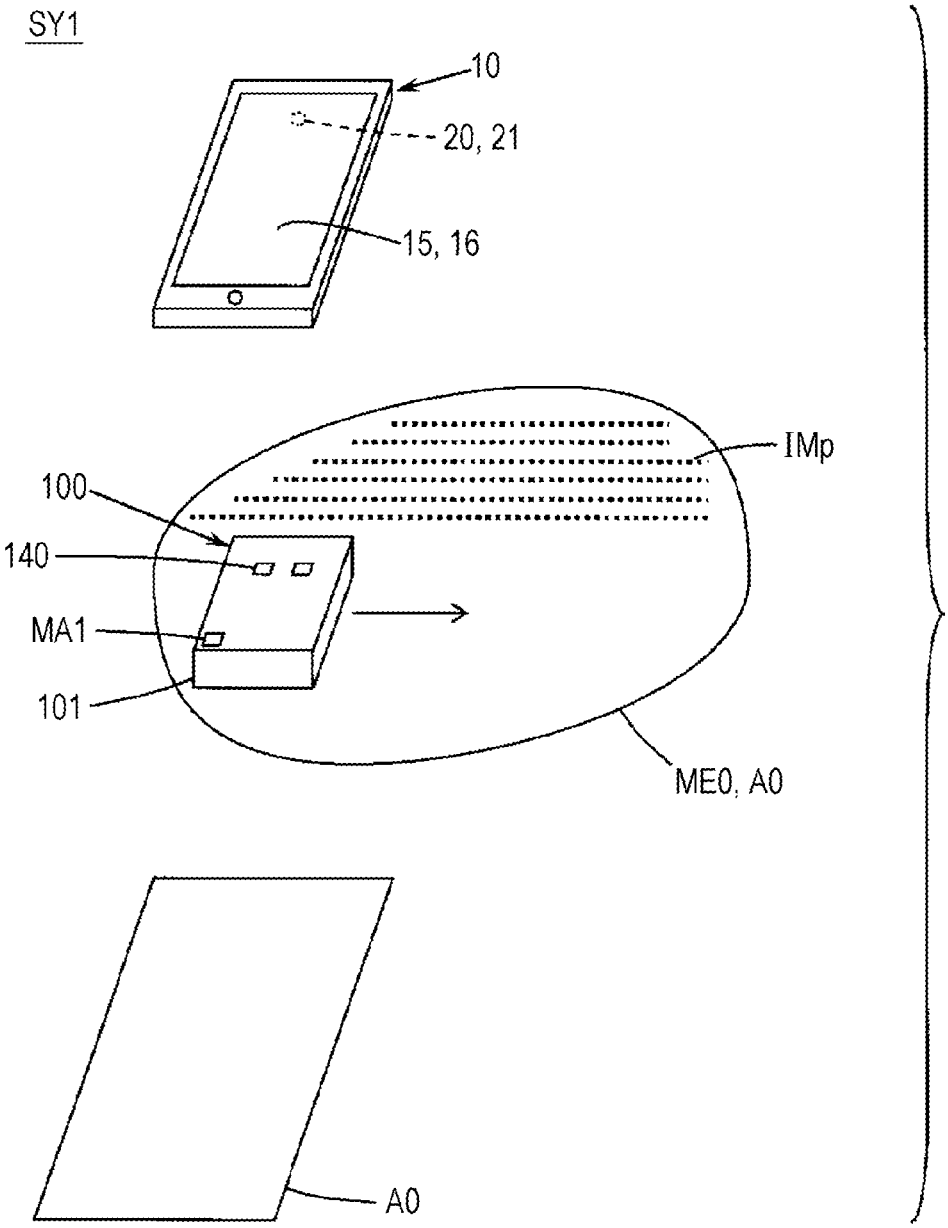
FIG. 1 is a perspective view schematically illustrating a configuration example of a print system.

Hereinafter, embodiments of the present disclosure will be described. The following embodiments are merely examples of the present disclosure, and all of features described in the embodiments are not essential for the present disclosure.

1. OUTLINE OF TECHNIQUE INCLUDED IN PRESENT DISCLOSURE

First, an outline of a technique included in the present disclosure will be described with reference to examples illustrated in FIGS. 1 to 24. The following embodiments include an embodiment which does not correspond to the claims. Further, the drawings are schematic diagrams illustrating examples. An enlargement ratio in each direction illustrated in the drawings may be different, and the drawings may not match with each other. Of course, each component of the present technique is not limited to a specific example indicated by a reference numeral. In "Outline of Technique included in Present Disclosure", contents in parentheses mean supplementary explanation of the preceding word.

Embodiment 1

Figure 19:
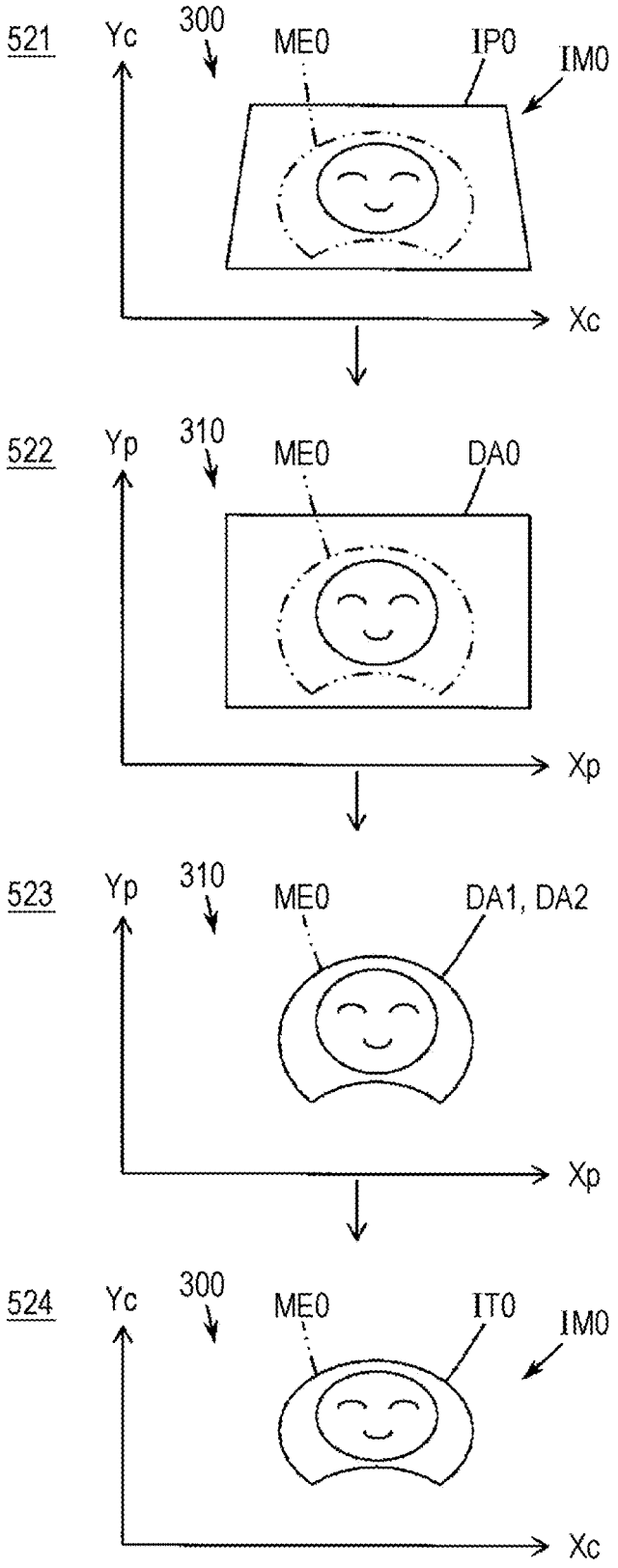
FIG. 19 is a diagram schematically illustrating an example of trimming a preview image in accordance with a print target.
Figure 20:
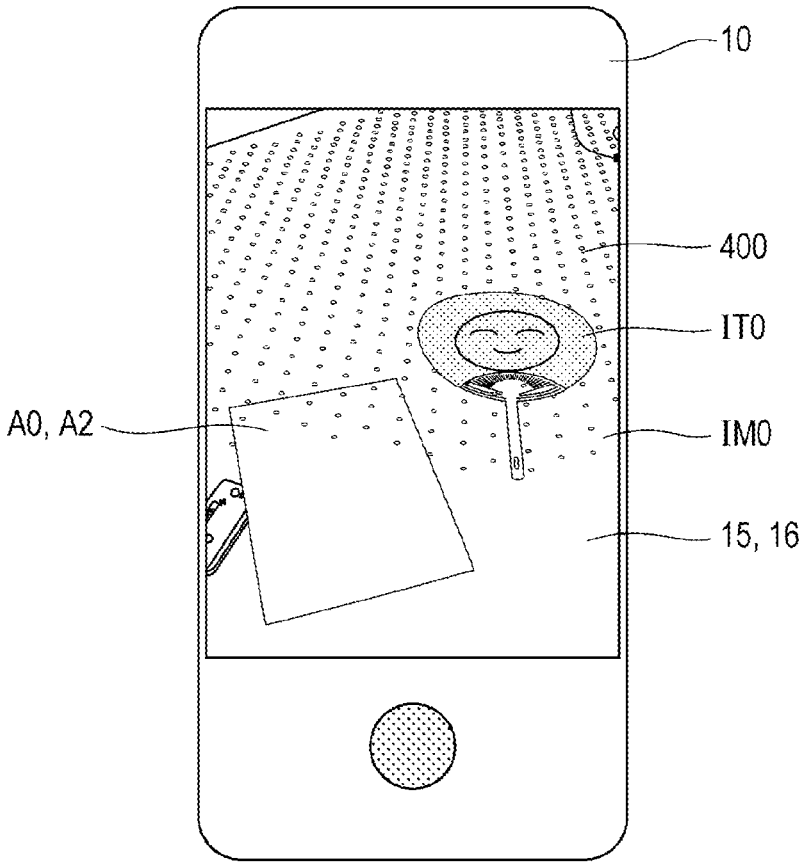
FIG. 20 is a diagram schematically illustrating an example of the print control device displaying a screen in which a trimmed image is superimposed on a captured image.

A print control device (for example, a portable host device 10 illustrated in FIG. 1) according to an embodiment of the present technique is a print control device 10 that causes a printing device (for example, a manual scanning type printer 100 illustrated in FIG. 1) to perform printing, and includes a specifying section U1, a display section U2, a setting receiving section U3, a print instruction receiving section U4, and a control section U6. The specifying section U1 specifies a print target ME0 from a captured image IM0 captured by an image capturing sensor 21. As illustrated in FIGS. 19 and 20, the display section U2 displays, on a display 16, a screen in which a trimmed image IT0 is superimposed on the captured image IM0, the trimmed image IT0 being obtained by trimming a preview image IP0 of original print data DA0 in accordance with the print target ME0. As illustrated in FIG. 17B, the setting receiving section U3 receives a setting of a relative position of the preview image IP0 with respect to the print target ME0. The print instruction receiving section U4 receives a print instruction at the relative position. The control section U6 causes the printing device 100 to perform printing on the print target ME0 based on the original print data DA0 and the relative position according to the print instruction.

In the embodiment 1, the screen in which the trimmed image IT0 is superimposed on the captured image IM0 is displayed, the trimmed image IT0 being obtained by trimming the preview image IP0 of the original print data DA0 in accordance with the print target ME0. A user can set the relative position of the preview image IP0 with respect to the print target ME0, and can instruct printing at the set relative position. The printing device 100 performs printing on the print target ME0 based on the original print data DA0 and the relative position, according to the print instruction. According to the present embodiment, the original print data DA0 with a size larger than a size of the print target ME0 can be handled, and the preview image IP0 does not overlap with a portion protruding from the print target ME0. Thus, an expected print result can be easily confirmed. Therefore, according to the present embodiment, a print control device capable of obtaining a more desired print result can be provided.

Embodiment 2

The specifying section U1 may specify the print target ME0 in a three-dimensional coordinate. As illustrated in FIGS. 19 and 20, the display section U2 may display, on the display 16, the screen in which the trimmed image IT0 is superimposed on the captured image IM0, the trimmed image IT0 being obtained by trimming the preview image IP0 in accordance with the print target ME0 in the three-dimensional coordinate. According to the present embodiment, an expected print result can be three-dimensionally confirmed, and then the expected print result can be printed on the print target ME0. Therefore, a more desired print result can be obtained.

Embodiment 3

The setting receiving section U3 may receive a setting of the relative position in the three-dimensional coordinate. The control section U6 may generate print data DA1 by cutting the original print data DA0 in accordance with a shape of the print target ME0, the original print data DA0 being obtained based on the relative position with respect to the print target ME0 in the three-dimensional coordinate, and may cause the printing device 100 to perform printing on the print target ME0 based on the print data DA1. According to the present embodiment, printing is performed according to the shape of the print target ME0, and thus a more desired print result can be obtained.

Embodiment 4

As illustrated in FIG. 17B, the setting receiving section U3 may receive, as the relative position, a setting of at least one of a size and a rotation angle of the preview image IP0. According to the present embodiment, an expected print result obtained by changing at least one of the size and the rotation angle of the preview image can be confirmed, and then the expected print result can be printed on the print target ME0. Therefore, a more desired print result can be obtained.

Embodiment 5

Figure 17A:
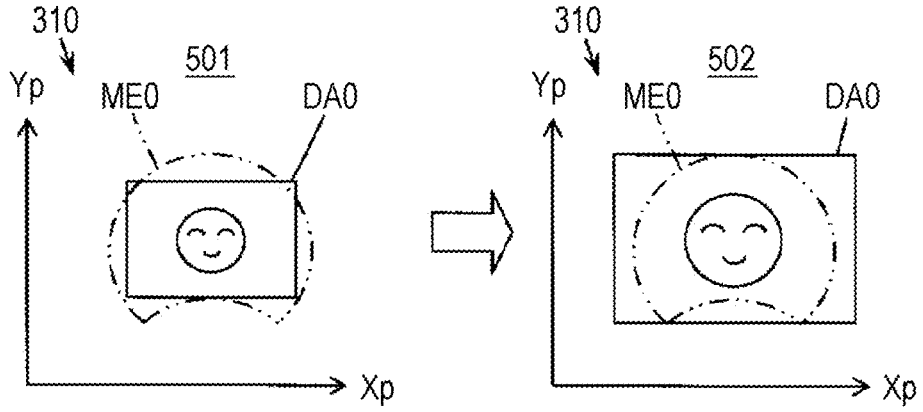
FIG. 17A is a diagram schematically illustrating an example of modifying original print data such that a print target is included.
Figure 17B:
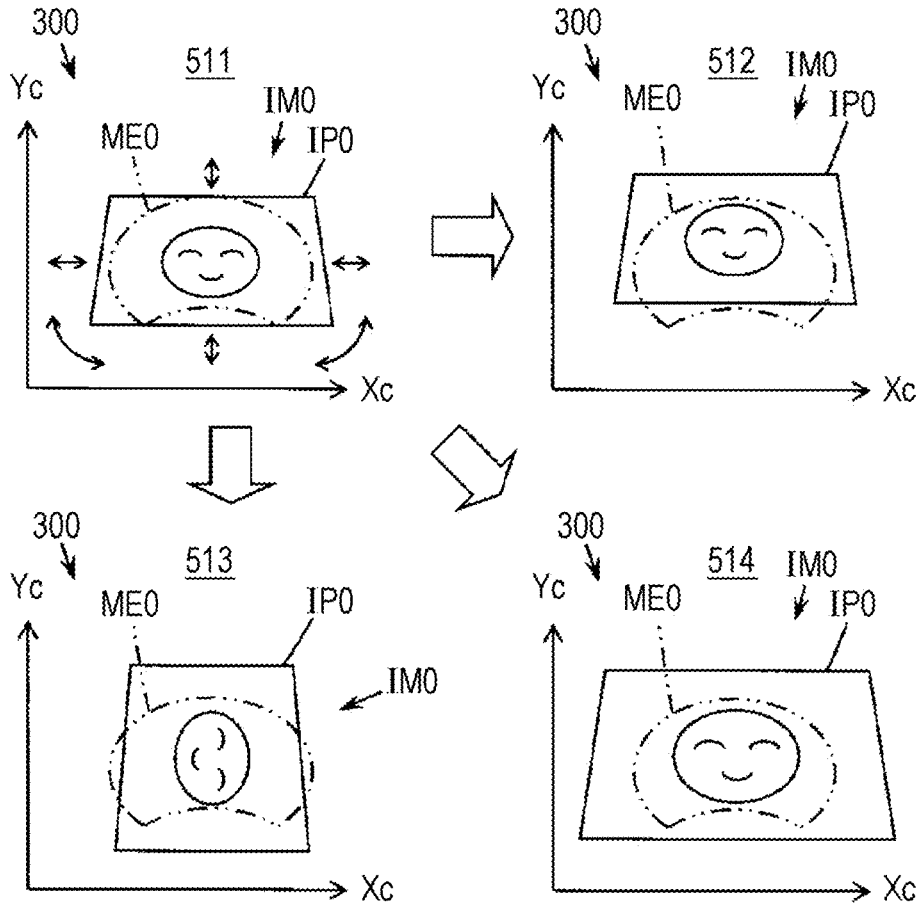
FIG. 17B is a diagram schematically illustrating an example of receiving a setting of a relative position of a preview image with respect to a print target.
Figure 18:
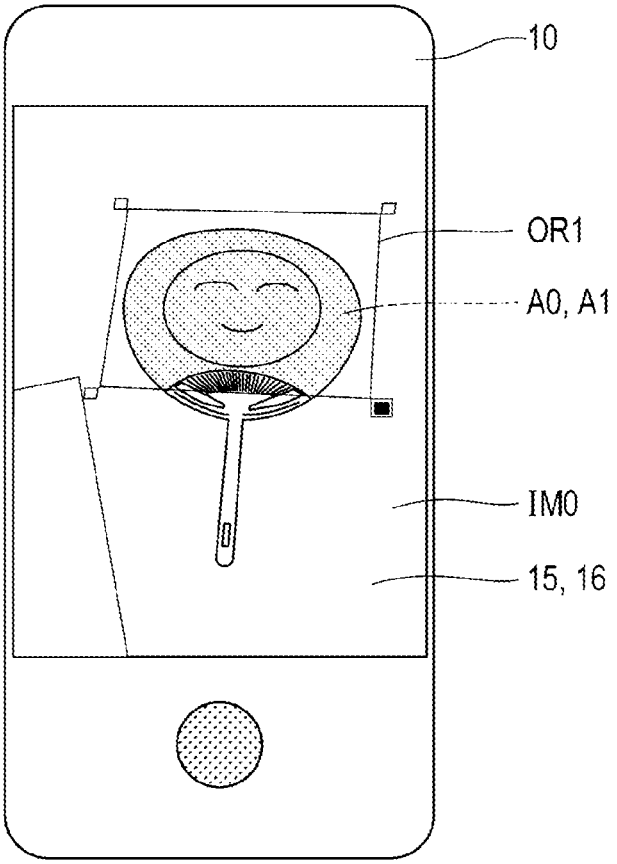
FIG. 18 is a diagram schematically illustrating an example of a screen for receiving a setting of a relative position of a preview image with respect to a print target.

As illustrated in FIGS. 17A and 18, the display section U2 may modify the preview image IP0 such that the print target ME0 is included, and may display, on the display 16, the screen in which the trimmed image IT0 is superimposed on the captured image IM0, the trimmed image IT0 being obtained by trimming the modified preview image IP0 in accordance with the print target ME0. The control section U6 may cause the printing device 100 to perform printing on the print target ME0 based on print data DA1 obtained by modifying the original print data DA0 in accordance with the preview image IP0. According to the present embodiment, the preview image IP0 is automatically overlapped on the entire surface of the print target ME0, and printing is performed based on the print data DA1, which is obtained based on the modification of the preview image IP0. Therefore, a more desired print result can be obtained.

Embodiment 6

The print control device 10 may further include a relative position specifying section U5 that specifies a relative position relationship between the printing device 100 and the print target ME0 in the captured image IM0. The control section U6 may generate the print data DA1 based on the relative position relationship, and may cause the printing device 100 to perform printing on the print target ME0 based on the print data DA1. According to the present embodiment, alignment of the printing device 100 and the print target ME0 is automatically performed, and thus usability of the printing device can be improved.

Embodiment 7

The printing device 100 may be a manual scanning type printer or an automatic scanning type printer. According to the present embodiment, usability of a manual scanning type printer or an automatic scanning type printer can be improved.

Embodiment 8

Figure 15:
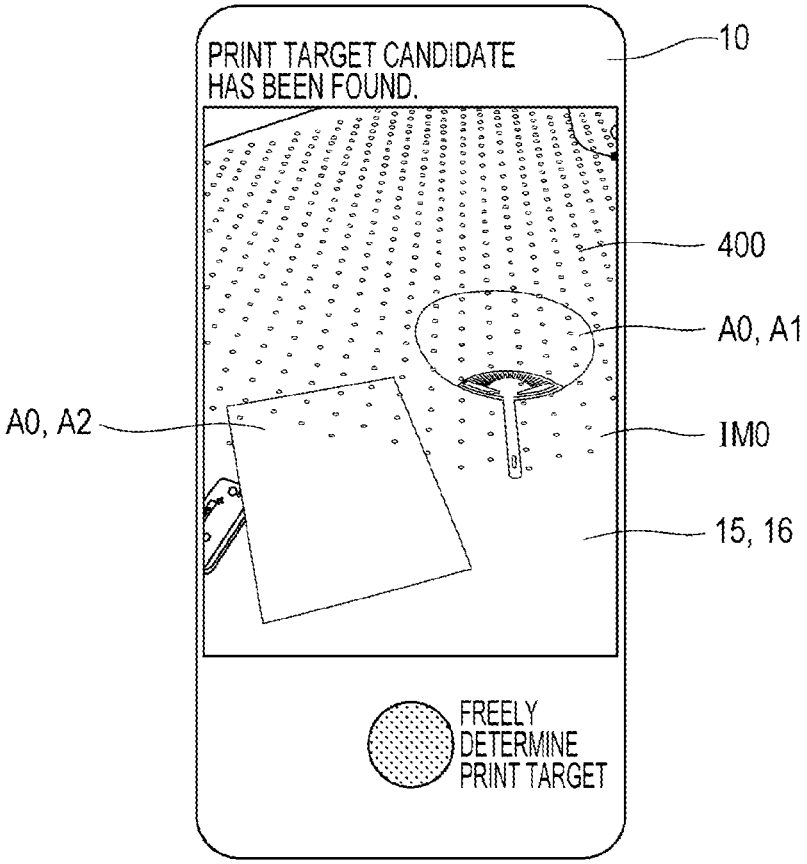
FIG. 15 is a diagram schematically illustrating an example of the print control device displaying a captured image including a print target candidate.

As illustrated in FIG. 15, the display section U2 may display, on the display 16, the screen in which a dot group 400 is added to a plane portion of the captured image IM0. According to the present embodiment, the plane portion of the captured image IM0 can be recognized, and thus convenience can be improved.

Embodiment 9

Figure 5:
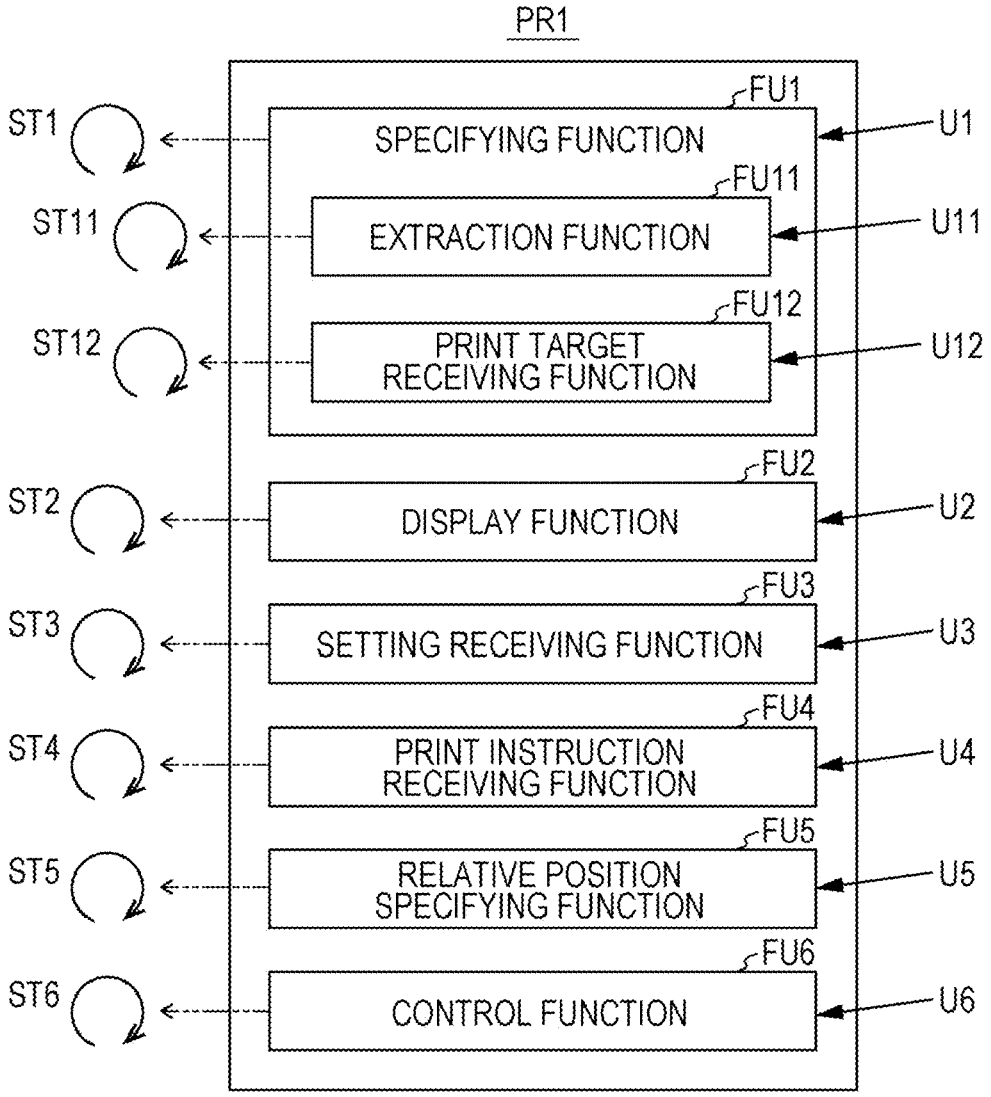
FIG. 5 is a block diagram schematically illustrating an example of a plurality of functions that a print control program causes a computer to realize.

Further, as illustrated in FIG. 5, a print control program PR1 corresponding to the embodiment 1 causes a computer to realize a specifying function FU1 corresponding to the specifying section U1, a display function FU2 corresponding to the display section U2, a setting receiving function FU3 corresponding to the setting receiving section U3, a print instruction receiving function FU4 corresponding to the print instruction receiving section U4, and a control function FU6 corresponding to the control section U6. According to the present embodiment, a print control program capable of obtaining a more desired print result can be provided. The print control program PR1 may cause a computer to realize a relative position specifying function FU5 corresponding to the relative position specifying section U5.

Embodiment 10

Further, as illustrated in FIG. 5, a printed matter production method corresponding to the embodiment 1 includes a specifying step ST1 corresponding to the specifying section U1, a display step ST2 corresponding to the display section U2, a setting receiving step ST3 corresponding to the setting receiving section U3, a print instruction receiving step ST4 corresponding to the print instruction receiving section U4, and a printing step ST6 corresponding to the control section U6. According to the present embodiment, a printed matter production method capable of obtaining a more desired print result can be provided. The printed matter production method may include a relative position specifying step ST5 corresponding to the relative position specifying section U5.

Embodiment 11

Figure 10:
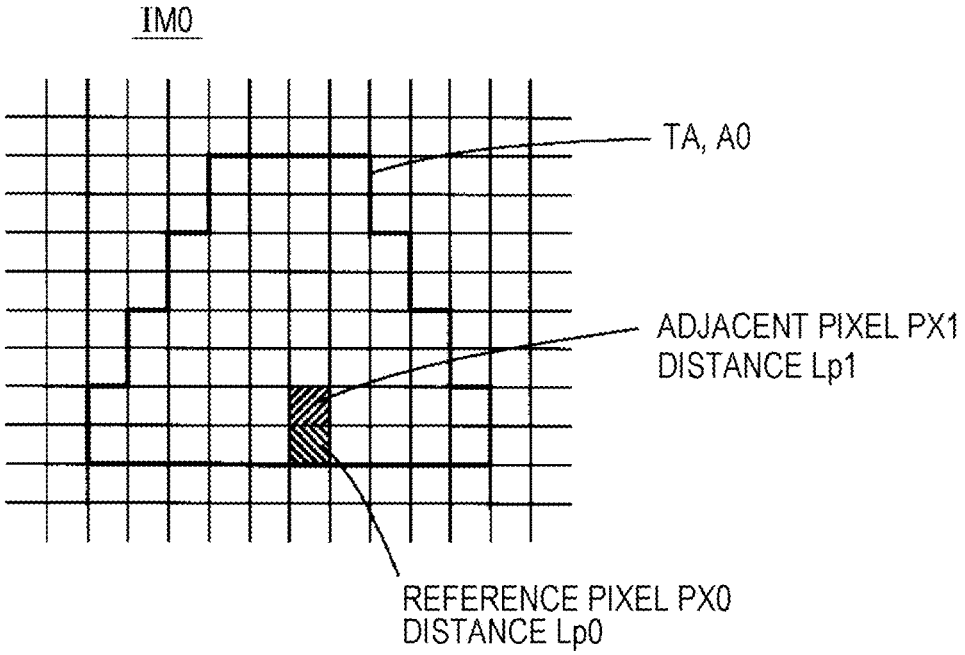
FIG. 10 is a diagram schematically illustrating an example of an area of a temporary print target candidate.

On the on the other hand, a print control device 10 according to another embodiment of the present technique is a print control device 10 that causes a printing device 100 to perform printing, and includes a specifying section U1 and a control section U6. As illustrated in FIG. 10 and the like, the specifying section U1 specifies, as a print target ME0, an area which is continuous in a predetermined range of colors based on a captured image IM0 captured by the image capturing sensor 21 and an object distance of each pixel of the captured image IM0. The control section U6 generates print data DA1 corresponding to the specified print target ME0, and causes the printing device 100 to perform printing on the print target ME0 based on the print data DA1.

In the embodiment 11, as the print target ME0, the area which is continuous in the predetermined range of colors is specified based on the captured image IM0 captured by the image capturing sensor 21 and the object distance of each pixel of the captured image IM0. Thus, an area which is not suitable for printing, such as a discontinuous portion in a depth direction, is excluded from the print target ME0. Therefore, according to the present embodiment, a print control device capable of improving usability can be provided.

Embodiment 12

The specifying section U1 may include an extraction section U11 that extracts, as a print target candidate A0, the area which is continuous in the predetermined range of colors, and may include a print target receiving section U12 that receives an operation of specifying the print target ME0 from the print target candidate A0. According to the present embodiment, a user can determine the print target ME0 from the print target candidate A0, and thus usability of the print control device can be further improved.

Embodiment 13

Figure 14A:
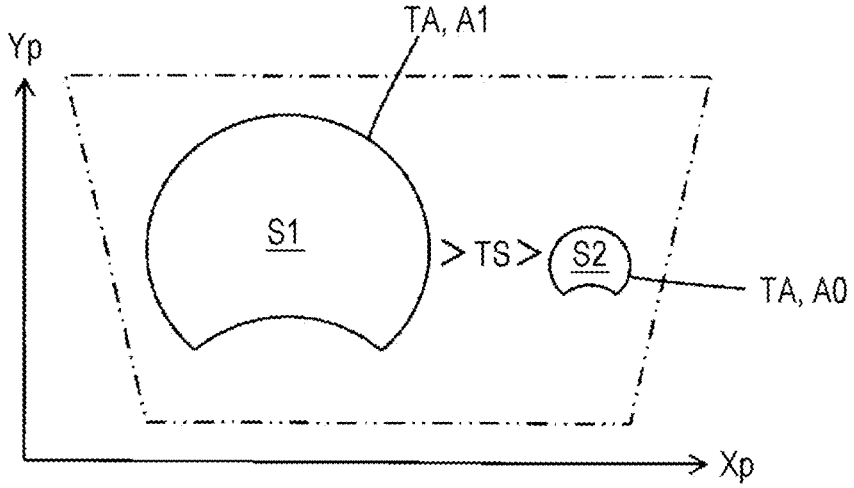
FIGS. 14A and 14B are diagrams schematically illustrating examples of sizes of temporary print target candidates.
Figure 14B:
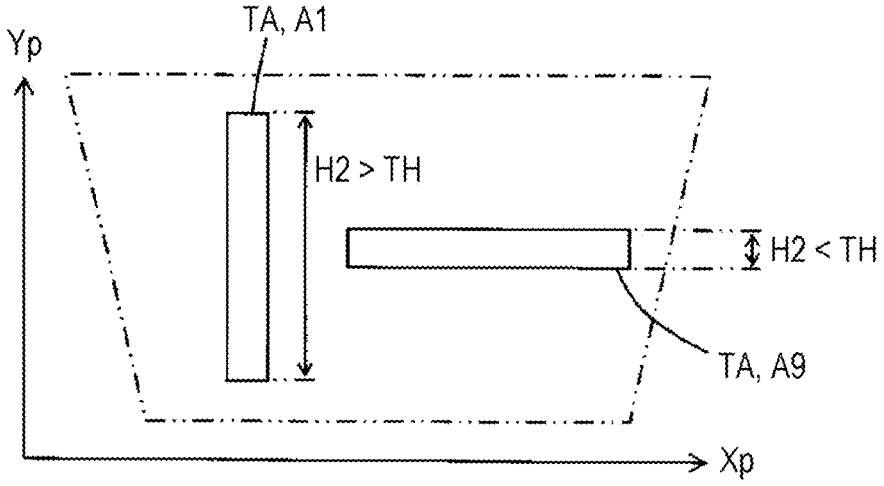

As illustrated in FIGS. 14A and 14B, the extraction section U11 may extract, as the print target candidate A0, the area which is continuous in the predetermined range of colors such that the area has a size equal to or larger than a predetermined size. According to the present embodiment, the print target candidate A0 having a size suitable for printing is extracted, and thus usability of the print control device can be further improved.

Embodiment 14

As illustrated in FIG. 19, the control section U6 may generate the print data DA1 by cutting the original print data DA0 associated with the print target ME0 in accordance with a shape of the print target ME0, and may cause the printing device 100 to perform printing on the print target ME0 based on the print data DA1. According to the present embodiment, printing is performed in accordance with the shape of the print target ME0, and thus usability of the printing device can be improved.

Embodiment 15

The control section U6 may obtain a facing shape (refer to FIG. 12) of the print target ME0 when facing the print target ME0 based on a view angle A1 (refer to FIG. 13) of the captured image IM0 included in a captured image group G1, generate the print data DA1 by cutting the original print data DA0 in accordance with the facing shape of the print target ME0, and cause the printing device 100 to perform printing on the print target ME0 based on the print data DA1. According to the present embodiment, a preferable example of performing printing in accordance with the shape of the print target can be provided.

Embodiment 16

The control section U6 may generate the print data DA1 by modifying the original print data DA0 associated with the print target ME0 such that the print target ME0 is included, and may cause the printing device 100 to perform printing on the print target ME0 based on the print data DA1. According to the present embodiment, printing can be performed on the entire surface of the print target.

Embodiment 17

The control section U6 may determine a size of the print target ME0 (refer to FIG. 13) based on an object distance L between the print target ME0 and the image capturing sensor 21 and a size of the print target ME0 in the captured image group G1, generate the print data DA1 by modifying the original print data DA0 associated with the print target ME0 based on the size of the print target ME0, and may cause the printing device 100 to perform printing on the print target ME0 based on the print data DA1. According to the present embodiment, printing can be performed in accordance with the size of the print target.

Embodiment 18

The control section U6 may generate the print data DA1 including information indicating the relative position relationship, and may transmit the print data DA1 to the printing device 100. According to the present embodiment, a preferable example of automatically performing aligning between the printing device and the print target can be provided.

Embodiment 19

On the other hand, as illustrated in FIG. 5, the print control program PR1 corresponding to the embodiment 11 causes a computer to realize a specifying function FU1 corresponding to the specifying section U1 and a control function FU6 corresponding to the control section U6. According to the present embodiment, the print control program capable of improving usability can be provided. The print control program PR1 may cause a computer to realize an extraction function FU11 corresponding to the extraction section U11, a print target receiving function FU12 corresponding to the print target receiving section U12, and a relative position specifying function FU5 corresponding to the relative position specifying section U5.

Embodiment 20

Further, as illustrated in FIG. 5, the printed matter production method corresponding to the embodiment 11 includes a specifying step ST1 corresponding to the specifying section U1 and a printing step ST6 corresponding to the control section U6. According to the present embodiment, the printed matter production method capable of improving usability can be provided. The printed matter production method may include an extraction step ST11 corresponding to the extraction section U11, a print target receiving step ST12 corresponding to the print target receiving section U12, and a relative position specifying step ST5 corresponding to the relative position specifying section U5.

Further, the present technique may be applied to a print system including a print control device and a printing device, a control method of the print control device, a control method of the print system, a computer-readable medium storing a print control program, a control program of the print system, a computer-readable medium storing the control program, and the like. Any of the devices may be configured with a plurality of distributed parts.

2. SPECIFIC EXAMPLE OF PRINT SYSTEM

FIG. 1 schematically illustrates a configuration example of a print system. The print system SY1 illustrated in FIG. 1 includes a manual scanning type handheld printer 100 as an example of a printing device and a portable host device 10 as an example of a print control device. The printer 100 includes a casing 101 having a size that can be held by a user's hand. The user holds the printer 100 with his/her hand, and slides the printer 100 along a surface of the print target ME0. Thereby, an image can be printed on the print target ME0. The printer 100 may be an automatic scanning type printer including a motor for movement. A marker MA1 for specifying a relative position relationship between the print target ME0 and the printer 100 and a button 140 for transmitting a print request to the host device 10 are provided on an upper surface of the printer 100. The printer 100 and the host device 10 are wirelessly connected to each other. On the other hand, the printer 100 and the host device 10 may be connected to each other by wire. The host device 10 functions as an augmented reality display device, which superimposes the image that the user wants to print on the captured image. The host device 10 has good usability, and can cause the printer 100 to output a desired print image IMp. When a plurality of print target candidates A0 are included in the captured image, the user can select the print target ME0 for printing the image.

Figure 2:
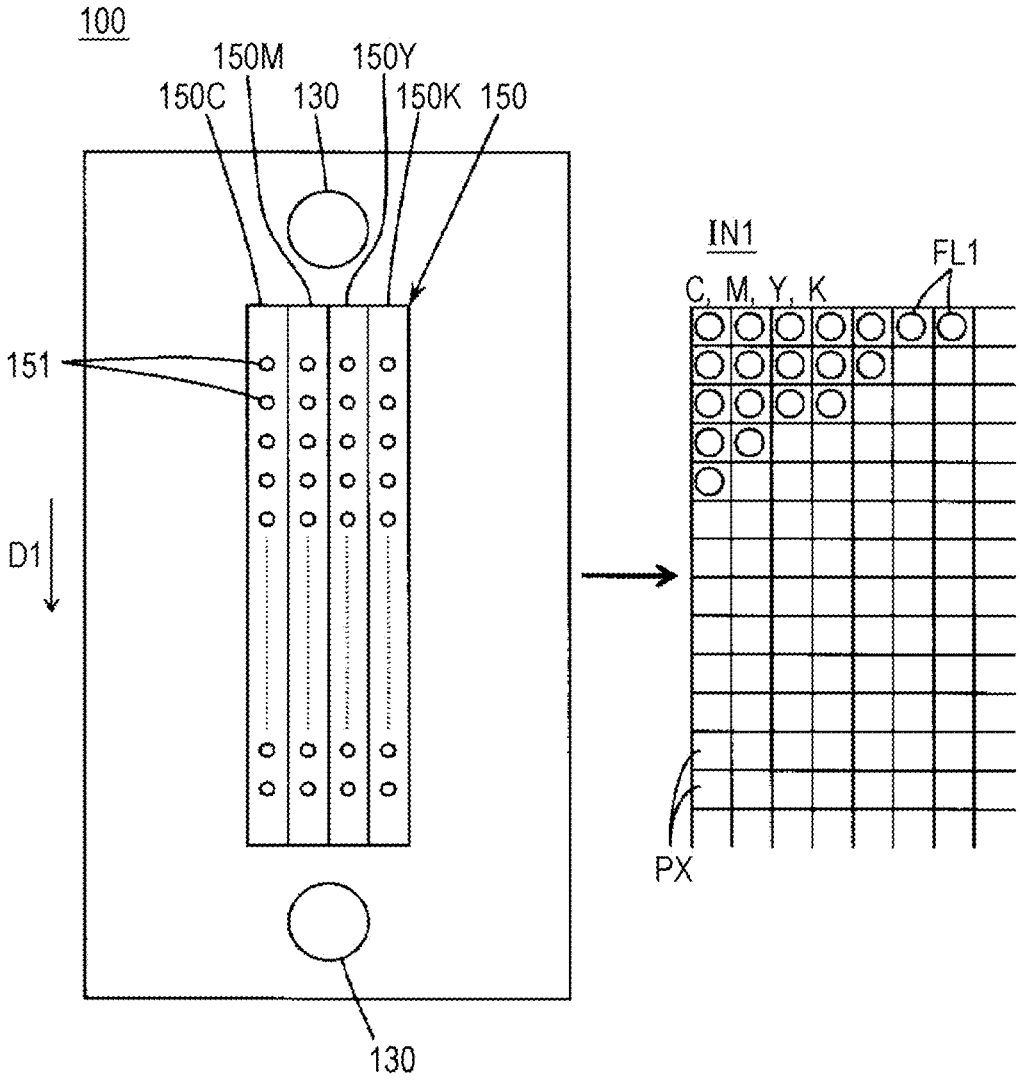
FIG. 2 is a diagram schematically illustrating an example of a bottom surface of a printing device and an example of mask information.

FIG. 2 schematically illustrates a bottom surface of the printer 100 and mask information IN1.

A plurality of movement amount detection sensors 130 and a recording head 150 are provided on the bottom surface of the printer 100. Each movement amount detection sensor 130 includes a light source such as a light emitting diode or a laser and an optical sensor that detects reflected light, and detects a movement direction and a movement distance of the movement amount detection sensor 130. In FIG. 2, one movement amount detection sensor 130 is disposed at a position from the recording head 150 toward a nozzle arrangement direction D1, and the remaining movement amount detection sensor 130 is disposed at a position from the recording head 150 toward a direction opposite to the nozzle arrangement direction D1. The disposition of each movement amount detection sensor 130 is not limited to the disposition illustrated in FIG. 2. The printer 100 includes the plurality of movement amount detection sensors 130, and thus the detection of the printer 100 is recognized. The recording head 150 includes a nozzle row 150C for discharging a cyan ink, a nozzle row 150M for discharging a magenta ink, a nozzle row 150Y for discharging a yellow ink, and a nozzle row 150K for discharging a black ink. Each of the nozzle rows 150C, 150M, 150Y, 150K includes a plurality of nozzles 151 arranged in the nozzle arrangement direction D1. Each nozzle 151 forms dots on the print target ME0 by discharging ink droplets. The nozzle rows 150C, 150M, 150Y, and 150K are arranged in a direction intersecting with the nozzle arrangement direction D1, for example, in FIG. 2, a direction perpendicular to the nozzle arrangement direction D1.

The mask information IN1 is information indicating a portion at which printing is previously performed in units of pixels, and includes mask information of cyan indicated by C, mask information of magenta indicated by M, mask information of yellow indicated by Y, and mask information of black indicated by K. FIG. 2 illustrates that a print completion flag FL1 is stored for a print completion pixel among a plurality of pixels PX in the mask information IN1. The mask information IN1 may be stored in the host device 10, may be stored in the printer 100, or may be stored in both of the host device 10 and the printer 100.

Figure 3:
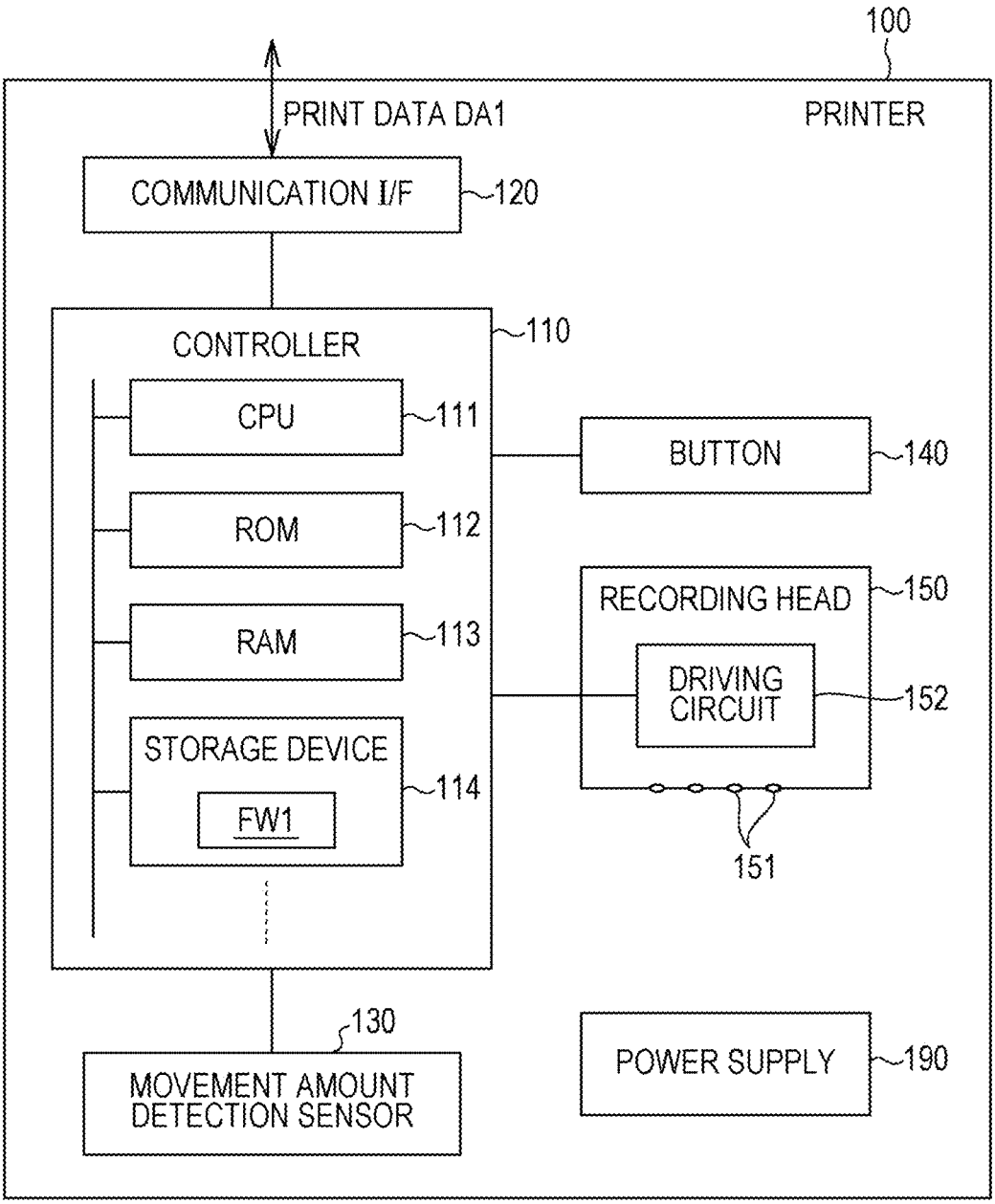
FIG. 3 is a block diagram schematically illustrating a configuration example of the printing device.

FIG. 3 schematically illustrates a configuration of the printer 100. The printer 100 illustrated in FIG. 3 includes a controller 110, a communication I/F 120, one or more movement amount detection sensors 130, one or more buttons 140, a recording head 150, and a power supply 190. Here, I/F is an abbreviation of an interface. The power supply 190 supplies power to each section of the printer 100. As the power supply 190, a battery including a rechargeable battery, a solar cell, a power receiving circuit from a power supply cable, or the like may be used.

The controller 110 includes a CPU 111, a ROM 112, a RAM 113, a storage device 114, and the like. The components 111 to 114 can receive and output information from and to each other by being electrically connected to each other. That is, the printer 100 is a type of a computer. The storage device 114 stores, for example, firmware FW1 that causes a computer to function as the printer 100. As the storage device 114, a nonvolatile semiconductor memory such as a flash memory may be used.

Figure 4:
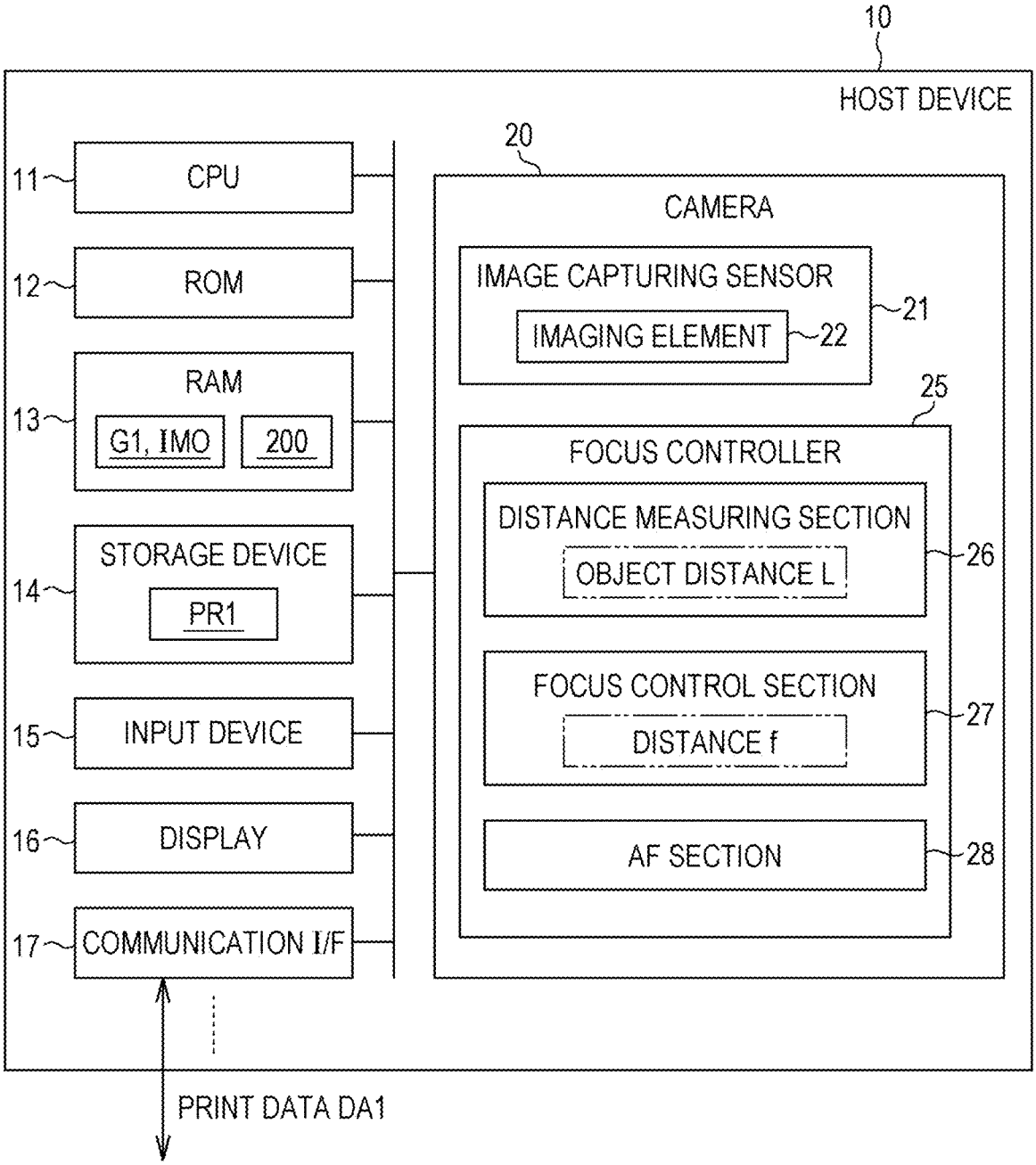
FIG. 4 is a block diagram schematically illustrating a configuration example of a print control device.

The communication I/F 120 can perform wireless communication with a communication I/F 17 of the host device 10 illustrated in FIG. 4. The communication I/F 120 can transmit relative position information based on a detection result of the movement amount detection sensor 130 to the host device 10, or receive the print data DA1 from the host device 10. As the communication I/F 120 and the communication I/F 17, a communication I/F based on a standard such as wireless LAN, Wi-Fi direct communication, short-range wireless communication, LTE communication, or infrared communication may be used. Here, LAN is an abbreviation of local area network, and LTE is an abbreviation of long term evolution.

The recording head 150 includes a driving circuit 152 for discharging ink droplets from each nozzle 151. The driving circuit 152 may include a circuit for driving a piezoelectric element that applies pressure to a liquid in a pressure chamber communicating with each nozzle 151, a circuit for driving a thermal element that generates bubbles by heating the liquid in the pressure chamber, and the like. The ink droplets land on the print target, and thus a print image IMp corresponding to the print data DA1 from the host device 10 is formed on the print target.

FIG. 4 schematically illustrates a configuration of the host device 10. The host device 10 illustrated in FIG. 4 includes a CPU 11, a ROM 12, a RAM 13, a storage device 14, an input device 15, a display 16, a communication I/F 17, a camera 20, and the like. The components 11 to 17 and 20 can receive and output information from and to each other by being electrically connected to each other. The host device 10 also includes a power supply (not illustrated). As the host device 10, a mobile terminal such as a smartphone or a tablet terminal, a digital camera such as a digital still camera or a digital video camera, a personal computer, or the like may be used.

The storage device 14 stores a print control program PR1 for causing a computer to function as a print control device. As the storage device 14, a nonvolatile semiconductor memory such as a flash memory may be used.

As the input device 15, a touch panel attached to a front surface of the display 16, a pointing device, a hard key including a keyboard, or the like may be used. As the display 16, a display panel such as a liquid crystal panel may be used. The communication I/F 17 can perform wireless communication with the communication I/F 120 of the printer 100. The communication I/F 17 can receive relative position information based on a detection result of the movement amount detection sensor 130 from the printer 100, or transmit the print data DA1 to the printer 100.

The camera 20 includes an image capturing sensor 21 and a focus controller 25, and has a zoom function of changing a zoom magnification.

The image capturing sensor 21 includes a plurality of imaging elements 22, an optical lens system (not illustrated), an auto gain controller (not illustrated), an analog-to-digital converter (not illustrated), and the like. The image capturing sensor 21 generates a captured image IM0 by capturing an image, and stores the captured image in the RAM 13. When a plurality of captured images IM0 are generated at predetermined time intervals, a captured image group is generated. As the imaging element 22, a CCD image sensor or the like may be used. Here, CCD is an abbreviation of a charge-coupled device.

The focus controller 25 includes a distance measuring section 26 that measures an object distance L, a focus control section 27 that controls a focus distance f, and an AF section 28. Here, AF is an abbreviation of autofocus. As the distance measuring section 26, a section that measures the object distance L by one of an active method, a passive method, or a combination of an active method or a passive method may be used. Here, in the active method, the distance measuring section measures the object distance L by, for example, irradiating the object with infrared rays or ultrasonic waves and detecting reflected waves together with a direction of the reflected waves. In the passive method, the distance measuring section measures the object distance L by detecting light from the object together with a direction of the light without using infrared rays or the like. A phase difference detection method or a contrast detection method may be adopted. The focus control section 27 performs a control of changing a focus distance f within a predetermined range. The AF section 28 determines a focus distance f based on the object distance L obtained by the distance measuring section 26, and outputs an instruction to set the focus distance f to the focus control section 27.

The configuration of the focus controller 25 is merely an example, and various configurations may be adopted for the focus controller.

FIG. 5 schematically illustrates a plurality of functions realized by the host device 10 according to the print control program PR1. The print control program PR1 illustrated in FIG. 5 causes the host device 10 to realize a specifying function FU1 including an extraction function FU11 and a print target receiving function FU12, a display function FU2, a setting receiving function FU3, a print instruction receiving function FU4, a relative position specifying function FU5, and a control function FU6.

The CPU 11 of the host device 10 performs various processing by reading a program stored in the storage device 14 into the RAM 13 and executing the read program as appropriate. The CPU 11 performs processing corresponding to the functions FU1 to FU6 by executing the print control program PR1 read into the RAM 13. The print control program PR1 causes the host device 10 as a computer to function as the specifying section U1 including the extraction section U11 and the print target receiving section U12, the display section U2, the setting receiving section U3, the print instruction receiving section U4, the relative position specifying section U5, and the control section U6. Further, the host device 10 that executes the print control program PR1 performs a specifying step ST1 including an extraction step ST11 and a print target receiving step ST12, a display step ST2, a setting receiving step ST3, a print instruction receiving step ST4, a relative position specifying step ST5, and a printing step ST6. The computer-readable medium storing the print control program PR1 is not limited to the storage device in the host device, and may be a recording medium outside the host device.

3. SPECIFIC EXAMPLE OF PROCESSING OF PRINT SYSTEM

Figure 6:
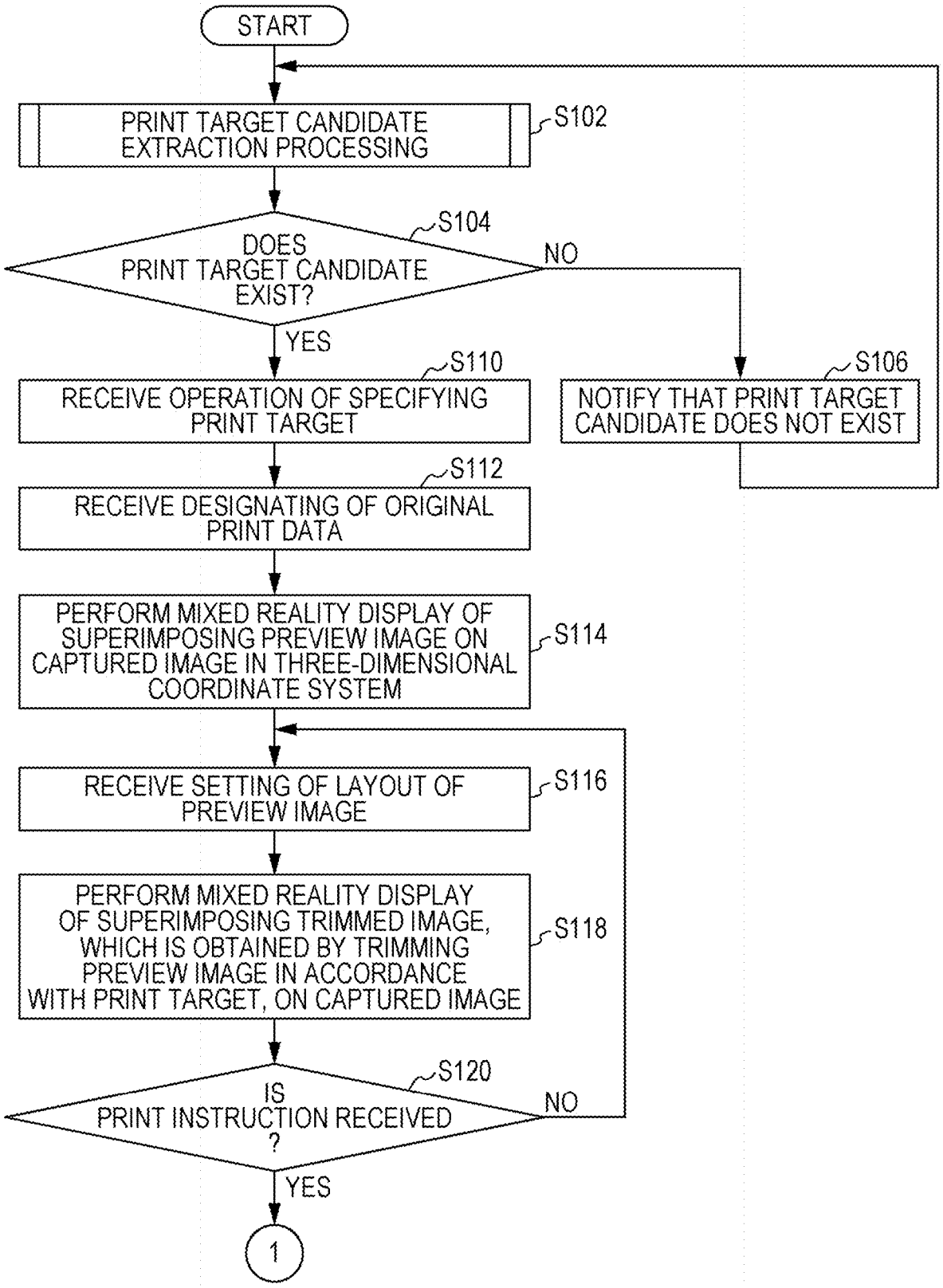
FIG. 6 is a flowchart schematically illustrating an example of print control processing performed by the print control device.
Figure 7:
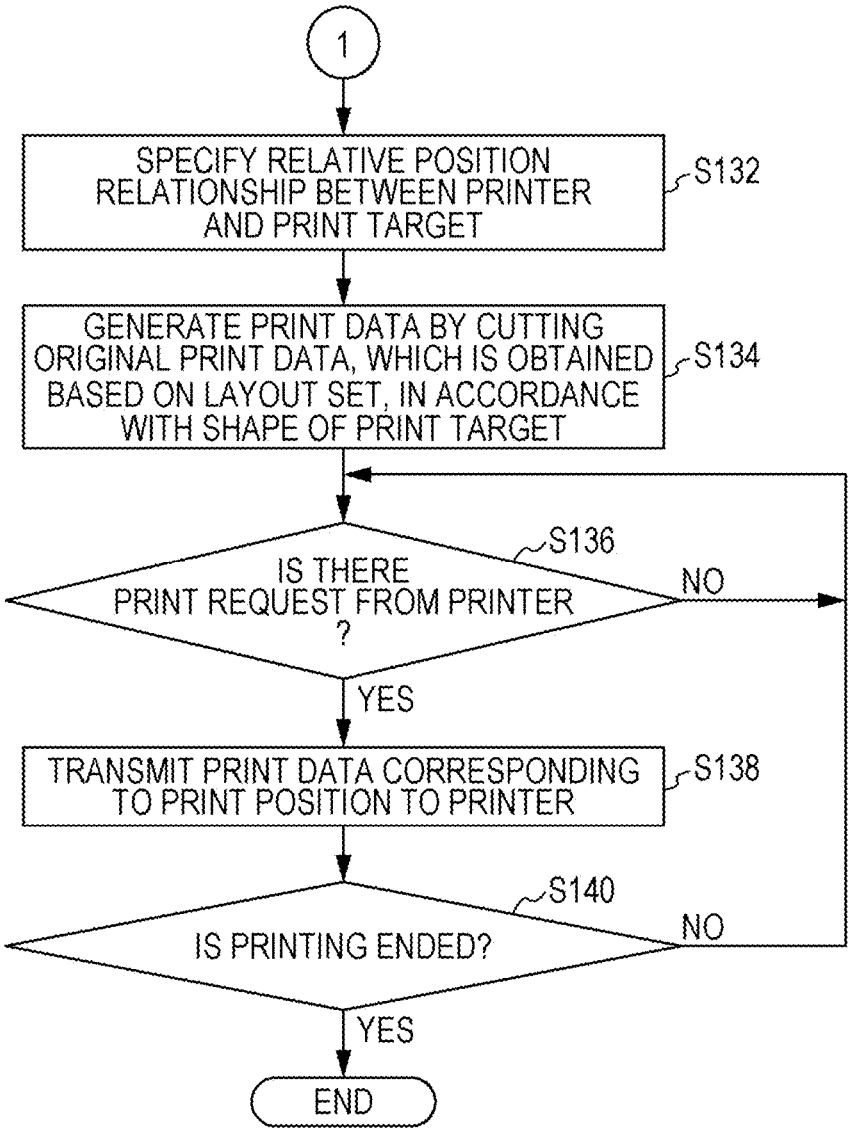
FIG. 7 is a flowchart schematically illustrating an example of print control processing performed by the print control device.
Figure 8:
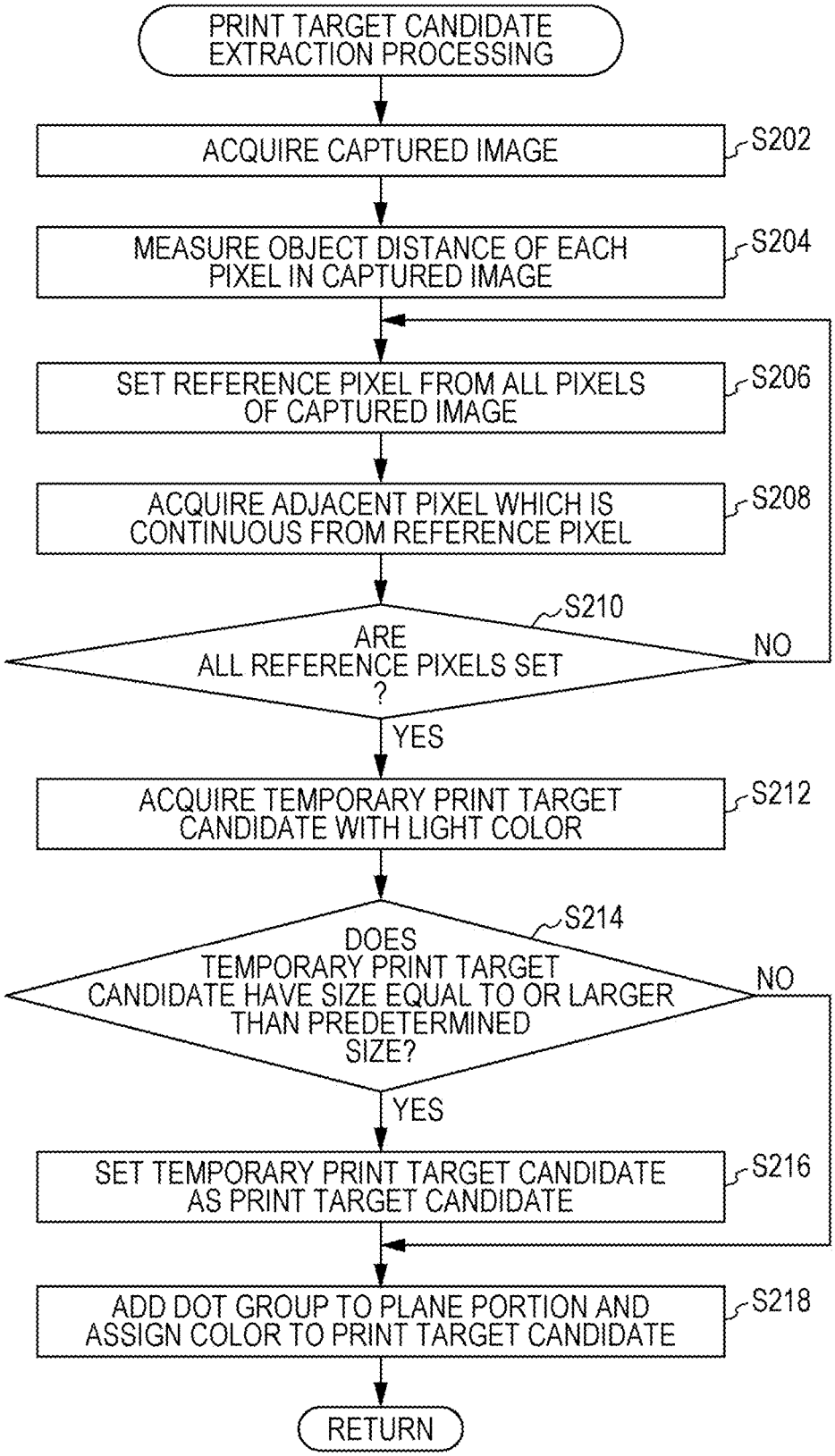
FIG. 8 is a flowchart schematically illustrating an example of print target candidate extraction processing performed by the print control device.

FIGS. 6 and 7 schematically illustrate print control processing performed by the host device 10. FIG. 8 schematically illustrates print target candidate extraction processing performed in step S102 of FIG. 6. The host device 10 performs a plurality of pieces of processing in parallel by multitask. Here, steps S202 to S216 of FIG. 8 and steps S104 to S110 of FIG. 6 correspond to the specifying section U1, the specifying function FU1, and the specifying step ST1. Steps S202 to S216 of FIG. 8 correspond to the extraction section U11, the extraction function FU11, and the extraction step ST11. Step S110 of FIG. 6 corresponds to the print target receiving section U12, the print target receiving function FU12, and the print target receiving step ST12. Step S218 of FIG. 8 and steps S112 to S114 and S118 of FIG. 6 correspond to the display section U2, the display function FU2, and the display step ST2. Step S116 of FIG. 6 corresponds to the print instruction receiving section U4, the print instruction receiving function FU4, and the print instruction receiving step ST4. Step S120 of FIG. 6 corresponds to the relative position specifying section U5, the relative position specifying function FU5, and the relative position specifying step ST5. Step S132 of FIG. 7 corresponds to the relative position specifying section U5, the relative position specifying function FU5, and the relative position specifying step ST5. Steps S134 to S140 of FIG. 7 correspond to the control section U6, the control function FU6, and the printing step ST6. Hereinafter, "step" is omitted, and reference numerals of each step are denoted in parentheses.

When the user performs an operation to execute the print control program PR1 on the host device 10, print control processing is started. For example, when the host device 10 is a smartphone and the print control program PR1 is a handheld-printer application program, the user may perform an operation to activate the handheld-printer application program on the smartphone. When the print control processing is started, the host device 10 performs print target candidate extraction processing illustrated in FIG. 8 (S102).

Figure 9:
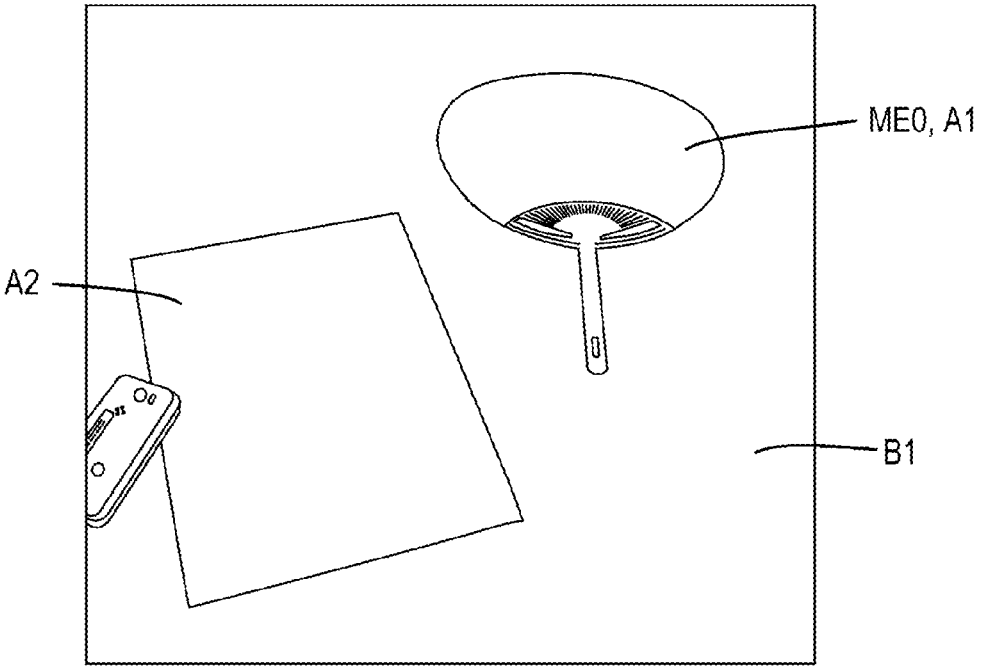
FIG. 9 is a diagram schematically illustrating an example of a print target candidate.

When the print target candidate extraction processing illustrated in FIG. 8 is started, the host device 10 activates the camera 20 when the camera 20 is not operated, causes the camera 20 to capture an image with a pan focus, and acquires the captured image IM0 (S202). It is assumed that objects are print target candidates A1 and A2 as illustrated in FIG. 9. FIG. 9 illustrates that print target candidates A1 and A2 are placed on a stand B1 such as a table. When the print target candidates are collectively referred to, the reference numeral A0 is used, and when the print target candidates are individually described, the reference numerals A1 and A2 are used.

Thereafter, the host device 10 measures an object distance of each pixel in the captured image IM0 using the distance measuring section 26 (S204).

After the captured image IM0 is acquired, the host device 10 performs processing of acquiring a temporary print target candidate, which is a print target candidate, from the captured image IM0. FIG. 10 schematically illustrates an area of the temporary print target candidate TA. The reason why the print target candidate is referred to as "temporary print target candidate" is to exclude "temporary print target candidate" having a size smaller than a predetermined size from the print target candidate in later processing.

The temporary print target candidate TA is, for example, an area in which substantially the same light color is continuous. Specifically, when a pixel included in a range corresponding to a light color is set as a reference pixel PX0, a pixel, of which the distance measured by the distance measuring section 26 is the same or similar among pixels adjacent to the reference pixel PX0 and of which the distance from a color of the reference pixel in a predetermined color space is equal to or shorter than a threshold value, is handled as being included in the same area as the reference pixel PX0.

First, the host device 10 sets the reference pixel PX0 in order from all pixels of the captured image IM0 (S206). In FIG. 10, the object distance of the reference pixel PX0 measured by the distance measuring section 26 is indicated by Lp0.

After the reference pixel PX0 is set, the host device 10 acquires a temporary print target candidate TA from the captured image IM0 based on the reference pixel PX0 as reference (S208). For example, first, the host device 10 acquires an adjacent pixel PX1, which is included in adjacent pixels vertically and horizontally adjacent to the reference pixel PX0, of which the distance measured by the distance measuring section 26 is the same or similar, and of which the distance from a color of the reference pixel PX0 in a predetermined color space is equal to or shorter than a threshold value. When a difference in distance is equal to or smaller than a threshold value, it is determined that the distance is similar. The adjacent pixel PX1 is a pixel in the same temporary print target candidate TA as the reference pixel PX0. In FIG. 10, the distance of the adjacent pixel PX1 measured by the distance measuring section 26 is indicated by Lp1. A fact that the adjacent pixel PX1 is in the same temporary print target candidate TA as the reference pixel PX0 means, for example, that $|Lp1-Lp0|$ is equal to or smaller than a predetermined threshold value.

In color, the pixel, of which the distance from a color of the reference pixel in a predetermined color space is equal to or shorter than a threshold value, is handled as being included in the same area as the reference pixel. On the other hand, a pixel, in which all color component values or hue and chroma are within a predetermined range when the reference pixel is set as reference, may be handled as being included in the same area as the reference pixel.

The host device 10 repeats processing of S206 to S208 until all the reference pixels PX0 are set from the captured image IM0 (S210). After processing of S206 to S210, the host device 10 acquires a temporary print target candidate TA by connecting portions at which the reference pixel PX0 and the adjacent pixel PX1 are adjacent to each other and selecting a light color area in the captured image IM0 (S212). The light color means, for example, a color with which a luminance value or a brightness value indicated by a pixel value is equal to or higher than a predetermined value. When a pixel value is represented by an RGB value, as the luminance value, an arithmetic mean of a R value, a G value, and a B value, an average of the R value, the G value, and the B value with different weights, or the like may be used. Here, R means red, G means green, and B means blue.

Next, the host device 10 branches the processing depending on whether or not the temporary print target candidate TA has a size equal to or larger than a predetermined size (S214). When the temporary print target candidate TA has a size smaller than the predetermined size, the host device 10 does not set the temporary print target candidate TA as a print target candidate, and the processing proceeds to S218. When the temporary print target candidate TA has a size equal to or larger than the predetermined size, the host device 10 sets the temporary print target candidate TA as a print target candidate A0 (S216), and the processing proceeds to S218. The predetermined size is a size estimated as the actual size of the temporary print target candidate TA, and is not a size on the captured image IM0.

Figure 11:
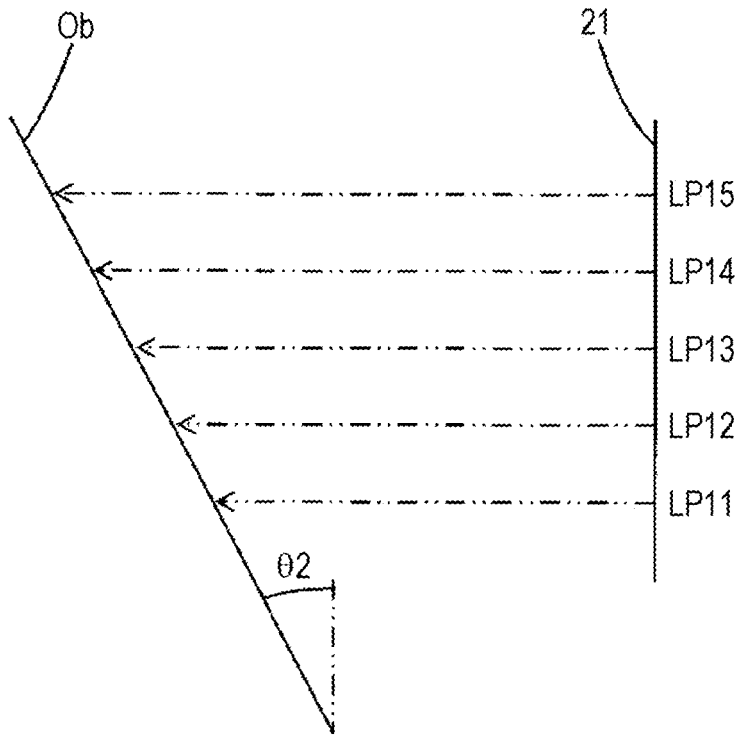
FIG. 11 is a diagram schematically illustrating an example in which an object is shifted from a direction facing an image capturing sensor.
Figure 12:
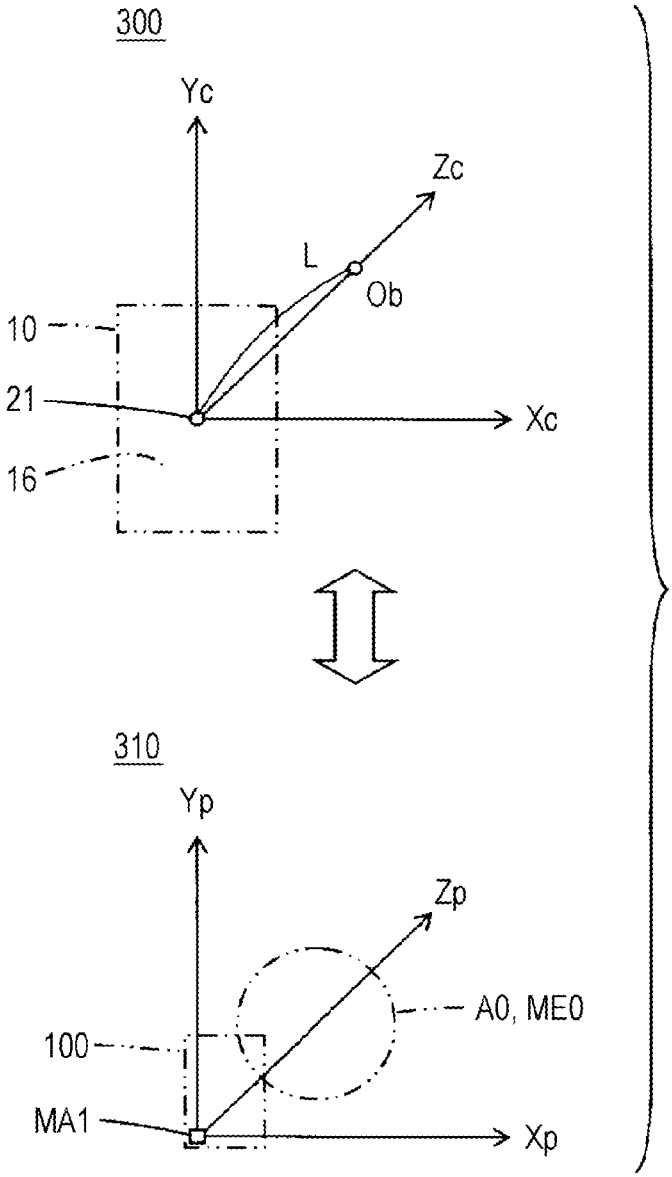
FIG. 12 is a diagram schematically illustrating an example of converting a three-dimensional coordinate.

The object included in the captured image IM0 does not always face the image capturing sensor 21, and is often shifted from a direction facing the image capturing sensor. For this reason, the actual size of the temporary print target candidate TA can be estimated by various known methods. Hereinafter, an example of an estimation method will be described. FIG. 11 schematically illustrates a state where the object Ob is shifted by an angle θ2 from a direction facing the image capturing sensor 21. FIG. 11 illustrates a state where distances Lp11, Lp12, Lp13, Lp14, and Lp15 from the image capturing sensor 21 to the object Ob increase in order. Thus, as illustrated in FIG. 12, a three-dimensional camera coordinate system 300 when the image capturing sensor 21 of the host device 10 is set as reference and a three-dimensional printer coordinate system 310 when the marker MA1 of the printer 100 is set as reference are set, and conversion between the coordinate systems 300 and 310 is appropriately performed. When the printer 100 is not included in the captured image IM0, the printer coordinate system 310, in which the temporary print target candidate TA, the print target candidate A0, or the print target ME0 is aligned on an Xp-Yp plane, may be set.

In the camera coordinate system 300 illustrated in FIG. 12, the captured image IM0 of the display 16 is aligned on an Xc-Yc plane, and a Zc axis is aligned with a direction from the image capturing sensor 21 toward the object Ob. The Xc axis, the Yc axis, and the Zc axis are perpendicular to each other. A Zc coordinate of the object Ob is the object distance L.

In the printer coordinate system 310 illustrated in FIG. 12, an upper surface of the printer 100 is aligned on an Xp-Yp plane, and a Zp axis is aligned with a direction from the marker MA1 toward the print target ME0. The Xp axis, the Yp axis, and the Zp axis are perpendicular to each other. A bottom surface of the printer 100, the temporary print target candidate TA, the print target candidate A0, and the print target ME0 are in a direction along the Xp-Yp plane. The printer coordinate system 310 may be set by using a feature portion such as a corner of the printer 100 as the marker MA1.

When an inclination of the object Ob included in the captured image IM0 from a position facing the image capturing sensor 21 is known, a coordinate value (Xc, Yc, Zc) of the camera coordinate system 300 can be converted to a coordinate value (Xp, Yp, Zp) of the printer coordinate system 310 by a determinant using a three-dimensional coefficient matrix. Further, the coordinate value (Xp, Yp, Zp) of the printer coordinate system 310 can be converted to the coordinate value (Xc, Yc, Zc) of the camera coordinate system 300 by a determinant using an inverse matrix of the coefficient matrix. The inclination of the object Ob included in the captured image IM0 from the position facing the image capturing sensor 21 can be calculated from the three-dimensional coordinate value (Xc, Yc, Zc) of the object Ob when the object distance of each pixel in the captured image IM0 measured by the distance measuring section 26 is set to the Zc coordinate.

Figure 13:
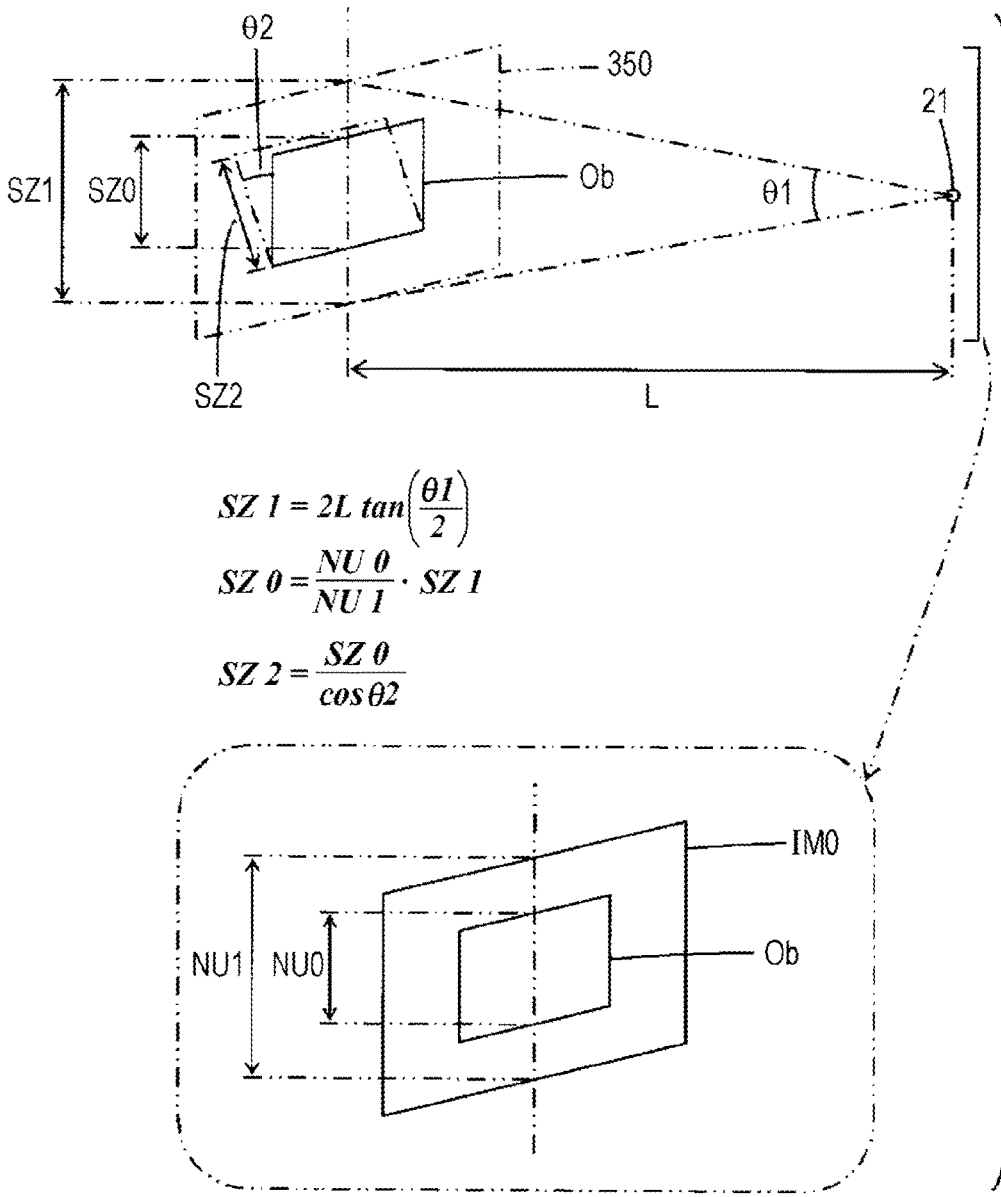
FIG. 13 is a diagram schematically illustrating an example of obtaining a size of the object.

FIG. 13 is a diagram schematically illustrating an example of obtaining a size of the object Ob. First, a description will be given assuming that the object Ob is in a direction facing the image capturing sensor 21. In FIG. 13, a size SZ0 is a length of the object Ob in a certain direction when a certain captured image IM0 is captured, and is expressed, for example, in units of meters. A size SZ1 is a length of an image capturing range 350 in the direction when the captured image IM0 is captured, and is expressed, for example, in units of meters. The number of pixels NU0 is the number of pixels of the object Ob in the captured image IM0 in the direction, and the number of pixels NU1 is the number of pixels of the captured image IM0 in the direction. When using a view angle θ1 of the image capturing range 350 in the direction, as a simple calculation example, the size SZ1 of the image capturing range 350 is calculated by the following equation.

$$SZ1=2L\tan(\theta 1/2)$$

Further, the size SZ0 of the object Ob is calculated by the following equation.

$$SZ0=(NU0/NU1)SZ1$$

In practice, the object Ob often does not face the image capturing sensor 21 in many cases. When the object Ob is shifted from the direction facing the image capturing sensor 21 by an angle θ2, as a simple calculation example, the size SZ2 of the object Ob is calculated by the following equation.

$$SZ2=SZ0/\cos\theta 2$$

As described above, the size SZ0 of the object Ob is determined based on the object distance L and the size of the object Ob in the captured image IM0. Further, the view angle θ1 changes according to a zoom magnification, and thus the size SZ0 of the object Ob changes according to the view angle θ1.

The coordinate of the temporary print target candidate TA is converted to a coordinate on the Xp-Yp plane of the printer coordinate system 310, and then the size of the temporary print target candidate TA is determined. The temporary print target candidate TA on the Xp-Yp plane has a facing shape obtained based on, for example, the view angle θ1 of the captured image IM0. The size of the temporary print target candidate TA may be determined based on an area as illustrated in FIG. 14A, or may be determined based on a height which is a length in the Yp axis direction as illustrated in FIG. 14B.

As illustrated in FIG. 14A, it is assumed that a temporary print target candidate TA having an area S1 larger than an area threshold value TS and a temporary print target candidate TA having an area S2 smaller than the threshold value TS are extracted after connection processing. The threshold value TS may be, for example, approximately the square of a length of the nozzle rows 150C, 150M, 150Y, and 150K in a nozzle arrangement direction D1 illustrated in FIG. 2, and is not limited thereto. The temporary print target candidate TA having the area S1>TS is set as a print target candidate A1 suitable for printing. The temporary print target candidate TA having the area S2<TS is an area A9 which is not suitable for printing.

As illustrated in FIG. 14B, it is assumed that a temporary print target candidate TA having a height H1 higher than a height threshold value TH and a temporary print target candidate TA having a height H2 lower than the threshold value TH are extracted after connection processing. The threshold value TH may be, for example, approximately the length of the nozzle rows 150C, 150M, 150Y, and 150K in a nozzle arrangement direction D1 illustrated in FIG. 2, and is not limited thereto. The temporary print target candidate TA having the height H1>TH is set as a print target candidate A1 suitable for printing. The temporary print target candidate TA having the height H2<TH is an area A9 which is not suitable for printing.

After setting the print target candidate A0, as illustrated in FIG. 15, the host device 10 adds a dot group 400 to the plane portion of the captured image IM0 which is displayed, assigns a predetermined color to the print target candidate A0 (S218), and ends the print target candidate extraction processing. The host device 10 acquires a three-dimensional coordinate value of a smooth surface on a background of the print target candidate A0 in the printer coordinate system 310, extracts a plane portion of the captured image IM0 based on the three-dimensional coordinate value, and adds a dot group 400 to the plane portion. It is assumed that the captured image IM0 displayed on the display 16 is a still image with the focus distance f when the object is in focus in S202, and is not limited thereto. FIG. 15 illustrates an example in which the print target candidates A1 and A2 are extracted from the captured image IM0. The dot group 400 illustrated in FIG. 15 is represented as a collection of white points to clearly illustrate the plane portion in the captured image. By adding the dot group 400 to the plane portion of the captured image IM0, a user can know the plane portion of the captured image IM0, and can also know that the host device 10 does not correctly recognize the plane portion of the captured image IM0. The print target candidates A1 and A2 illustrated in FIG. 15 are not white but have a bright color so as to be conspicuous in the captured image IM0.

After the print target candidate extraction processing is ended, the host device 10 branches processing according to whether or not a print target candidate A0 exists in the captured image IM0 (S104 of FIG. 6). When a print target candidate A0 does not exist in the captured image IM0, the host device 10 causes the display 16 to display a notification that a print target candidate does not exist (S106), and the processing returns to S102. When the user moves the host device 10, the processing is repeated until one or more print target candidates A0 are included in the captured image, and the print target candidate extraction processing is repeated.

When one or more print target candidates A0 exist in the captured image IM0, the host device 10 receives an operation of selecting a print target from the one or more print target candidates A0 (S110). For example, for the print target candidates A0 in the captured image IM0, the print target candidates A0 are displayed on the display 16 so as to be distinguishable from each other, and the user is prompted to select which print target candidate A0 is to be printed. When the user selects one print target candidate A0 in response to the prompting, the host device 10 selects the selected print target candidate A0 as a print target. Until a print target is selected, the processing returns to S102 and the print target candidate extraction processing is repeated. Thereby, the user can select a medium on which the user wants to perform printing by moving the host device 10 before selecting one print target candidate A0. The user may select the print target candidate A0 by tapping display of the print target candidate A0 that the user wants to set as the print target ME0. In the following, an example, in which the print target candidate A1 is tapped and the print target candidate A1 is selected as the print target ME0 in the display of FIG. 15, will be described.

After specifying the print target ME0, the host device 10 receives an operation of designating original print data to be used for printing on the print target ME0 (S112).

Figure 16:
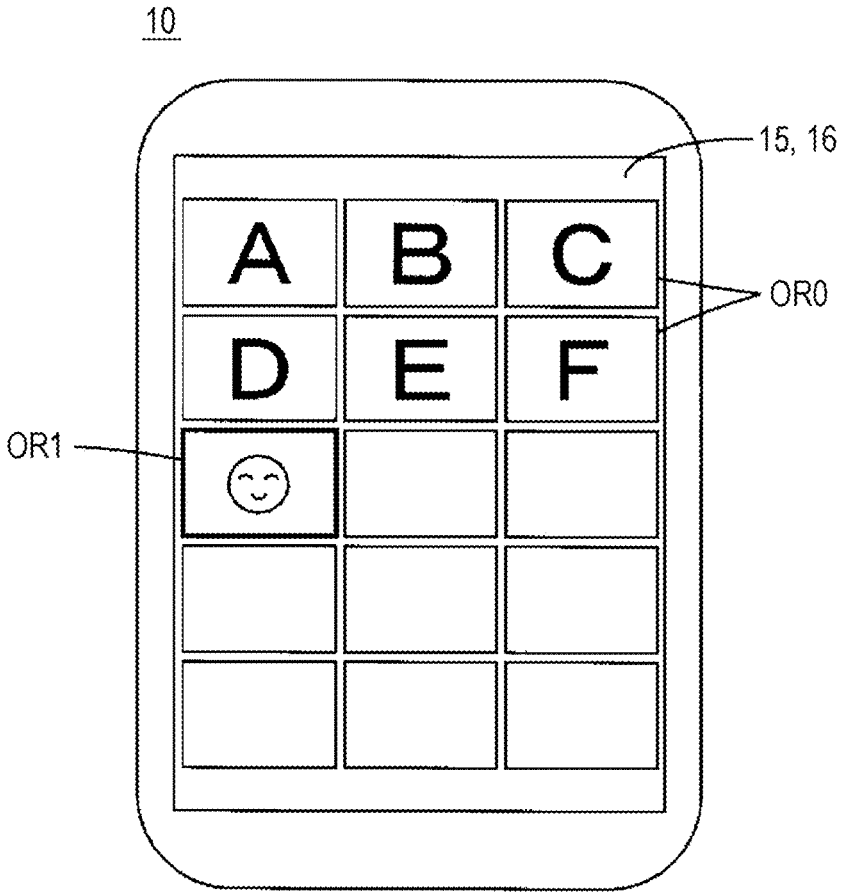
FIG. 16 is a diagram schematically illustrating an example of the print control device displaying an original image selection screen.

FIG. 16 schematically illustrates the host device 10 displaying an original image selection screen on the display 16. The original image selection screen includes one or more original images OR0 which can be used for printing on the print target ME0. As the original image OR0, a thumbnail image of the original print data may be used. For example, the host device 10 may display thumbnail images of the original images OR0 side by side on the display 16, and perform processing of receiving an operation of selecting any one thumbnail image from the displayed one or more thumbnail images by the input device 15. For example, when the user taps a certain thumbnail image, the original print data DA0 corresponding to the tapped thumbnail image is designated for printing on the print target ME0. FIG. 16 illustrates an original image OR1 as a tapped thumbnail image.

After designating the original print data DA0, the host device 10 causes the display 16 to perform mixed reality display of superimposing the preview image IP0 of the original image OR0 on the captured image IM0 in the three-dimensional coordinate system (S114). Hereinafter, the mixed reality display is referred to as MR display.

FIGS. 17A and 17B schematically illustrate how MR display of the preview image IP0 is performed based on the captured image IM0 in the three-dimensional camera coordinate system 300 illustrated in FIG. 12. In FIGS. 17A and 17B, the preview image IP0 is indicated by a solid line, and the print target ME0 is indicated by a two-dot chain line. For convenience, reference numerals 501, 502, and 511 to 514 are given to scenes illustrated in FIGS. 17A and 17B.

The original print data DA0 is prepared as data on the Xp-Yp plane of the printer coordinate system 310 illustrated in FIG. 12. First, as in the scene 502 illustrated in FIG. 17A, the host device 10 arranges the facing shape of the print target ME0 and the original print data DA0 on the Xp-Yp plane. In the present embodiment, as in the scene 502, the host device 10 arranges the preview image IP0 so as to circumscribe the print target ME0, and trims the preview image IP0 in accordance with the shape of the print target ME0. In the initial state, as in the scene 502 instead of the scene 501, a part of the print target ME0 does not protrude from the original print data DA0.

After modifying the preview image IP0, as in the scene 511 illustrated in FIG. 17B, the host device 10 generates the preview image IP0 on the Xc-Yc plane by converting the original print data DA0 on the Xp-Yp plane to print data in the camera coordinate system 300. The host device 10 may cause the display 16 to perform MR display of superimposing the preview image IP0 on the captured image IM0. MR display of the preview image IP0 based on the captured image IM0 is referred to as augmented reality display.

After MR display of the preview image IP0 is performed, the host device 10 receives a setting of a layout of the preview image IP0 with respect to the print target ME0 in the three-dimensional coordinate (S116). FIG. 18 schematically illustrates a screen for receiving a setting of a layout of the preview image IP0 with respect to the print target ME0. For example, the host device 10 may perform processing of receiving, by the input device 15, at least one of a touch operation of sliding the preview image IP0 displayed on the display 16, a touch operation of changing a size of the preview image IP0, or a touch operation of changing a rotation angle of the preview image IP0 on the Xp-Yp plane.

For example, when the user performs an operation of sliding the preview image IP0 of the scene 511 upward, as in the scene 512, the preview image IP0 slides upward based on the Xp-Yp plane as reference. At this time, the host device 10 may convert the three-dimensional preview image IP0 to a preview image IP0 in the printer coordinate system 310, slide the preview image IP0 on the Xp-Yp plane, convert the slid preview image IP0 to a preview image IP0 in the camera coordinate system 300, and superimpose the coordinate-converted preview image IP0 on the captured image IM0. Even when the preview image IP0 slides in a direction other than upward, for example, downward, left, or right, the host device 10 may perform similar processing.

When the user performs an operation of changing the rotation angle of the preview image IP0 of the scene 511, as in the scene 513, the rotation angle of the preview image IP0 is changed based on the Xp-Yp plane as reference. At this time, the host device 10 may convert the three-dimensional preview image IP0 to a preview image IP0 in the printer coordinate system 310, change the rotation angle of the preview image IP0 on the Xp-Yp plane, convert the changed preview image IP0 to a preview image IP0 in the camera coordinate system 300, and superimpose the coordinate-converted preview image IP0 on the captured image IM0. The operation of changing the rotation angle of the preview image IP0 may be an operation of rotating the preview image IP0 in a right direction or an operation of rotating the preview image IP0 in a left direction.

When the user performs an operation of changing the size of the preview image IP0 of the scene 511, as in the scene 514, the size of the preview image IP0 is changed based on the Xp-Yp plane as reference. At this time, the host device 10 may convert the three-dimensional preview image IP0 to a preview image IP0 in the printer coordinate system 310, change the size of the preview image IP0 on the Xp-Yp plane, convert the changed preview image IP0 to a preview image IP0 in the camera coordinate system 300, and superimpose the coordinate-converted preview image IP0 on the captured image IM0. The operation of changing the size of the preview image IP0 may be an operation of enlarging the preview image IP0 at the same magnification or at a magnification, or an operation of reducing the preview image IP0 at the same magnification or at a magnification.

As described above, the relative position of the preview image IP0 with respect to the print target ME0 in the three-dimensional coordinate is set. The host device 10 may receive a setting of the relative position of the preview image IP0 by any method. For this reason, the rotation angle of the preview image IP0 may not be changed, the size of the preview image IP0 may not be changed, and the preview image IP0 may not be slid.

When the user moves the host device 10, there is a change in the image previously captured. Therefore, the host device 10 performs processing of S102, S114, and S116 of FIG. 6 according to movement of the host device 10 or periodically, and displays, on the display 16, a screen in which the preview image IP0 is superimposed on a new captured image IM0.

After setting the relative position of the preview image IP0, as illustrated in FIG. 19, the host device 10 causes the display 16 to perform MR display of superimposing the trimmed image IT0 on the captured image IM0, the trimmed image IT0 being obtained by trimming, in accordance with the print target ME0, the preview image IP0 which is modified as necessary (S118). In FIG. 19, the preview image IP0, the original print data DA0, the print data DA1, and the trimmed image IT0 are indicated by solid lines, and the print target ME0 is indicated by a two-dot chain line. For convenience, reference numerals 521 to 524 are given to scenes illustrated in FIG. 19.

The scene 521 of FIG. 19 illustrates an example of the relative position of the preview image IP0 with respect to the print target ME0 on the Xc-Yc plane of the camera coordinate system 300. As illustrated in a scene 522, first, the host device 10 arranges the original print data DA0 on the Xp-Yp plane of the printer coordinate system 310 in accordance with the relative position of the preview image IP0 on the Xc-Yc plane. Next, as illustrated in the scene 523, the host device 10 generates the temporary print data DA2 by trimming the original print data DA0 on the Xp-Yp plane in accordance with the facing shape of the print target ME0. The reason why "temporary" is added is that, in a case where the relative position of the preview image IP0 is determined in a state illustrated in the scene 521 and the relative position relationship between the printer 100 and the print target ME0 is specified, the trimmed original print data DA0 may be used as the print data DA1 when the relative position relationship is added. Finally, as illustrated in the scene 524, the host device 10 generates a trimmed image IT0 by converting the temporary print data DA2 on the Xp-Yp plane into print data in the camera coordinate system 300, and superimpose the trimmed image IT0 on the captured image IM0. Thereby, as illustrated in FIG. 20, the display 16 performs MR display of superimposing the trimmed image IT0 on the captured image IM0, the trimmed image IT0 being obtained by trimming the preview image IP0 in accordance with the print target ME0 in the three-dimensional coordinate. The host device 10 performs processing of S102 and S118 of FIG. 6 according to movement of the host device 10 or periodically, and displays, on the display 16, a screen in which the trimmed image IT0 is superimposed on a new captured image IM0.

When the preview image IP0 does not protrude from the print target ME0, it is not necessary to trim the preview image IP0, and thus processing of S118 may be skipped.

After MR display of the trimmed image IT0, the host device 10 branches the processing according to whether or not a print instruction of the print data DA1 at the set relative position is received (S120). When the print instruction is not received, the host device 10 repeats processing of S116 to S120. When the print instruction is received, the processing proceeds to S132 of FIG. 7. For example, when a determination button (not illustrated) is displayed on the display 16 and a touch operation on the determination button is received by the input device 15, the host device 10 may determine that a print instruction is received, and the processing may proceed to S132. The user can change the layout of the preview image IP0 any number of times without tapping the determination button. In addition, the host device 10 may determine that a print instruction is received when an operation of capturing the printer 100 together with the print target ME0 is received. In this case, the processing may proceed to S132.

After receiving the print instruction, the host device 10 captures both of the print target ME0 and the printer 100 when the print target ME0 and the printer 100 are recognized, and specifies a relative position relationship between the printer 100 and the print target ME0 included in the captured image IM0 (S132).

Figure 21:
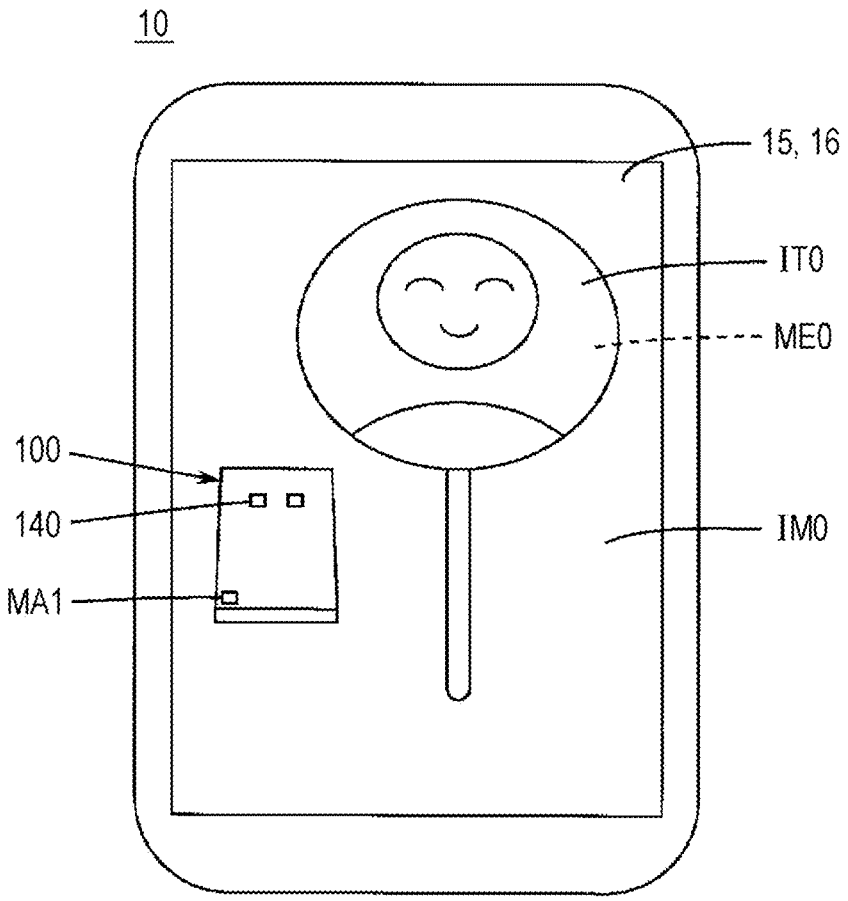
FIG. 21 is a diagram schematically illustrating an example of the print control device displaying a screen in which a trimmed image is superimposed on a captured image including a printing device and a print target.

FIG. 21 schematically illustrates the host device 10 displaying the captured image IM0 including the printer 100 and the print target ME0 on the display 16. A trimmed image IT0 is superimposed on the captured image IM0 illustrated in FIG. 21 in accordance with the print target ME0. First, the host device 10 obtains coordinates of the print target ME0 and the printer 100 in the three-dimensional camera coordinate system 300. The coordinate of the printer 100 include a coordinate of the marker MA1. The host device 10 can obtain a Zc-axis coordinate between the print target ME0 and the upper surface of the printer 100 based on the captured image IM0 captured by the image capturing sensor 21 and the object distance of each pixel in the captured image IM0 measured by the distance measuring section 26. Next, the host device 10 converts the three-dimensional coordinate values (Xc, Yc, Zc) of the print target ME0 and the printer 100 in the camera coordinate system 300 into three-dimensional coordinate values (Xp, Yp, Zp) in the printer coordinate system 310. Thus, the host device 10 can specify the relative position relationship between the printer 100 and the print target ME0 on the Xp-Yp plane of the printer coordinate system 310 based on the marker MA1 as reference. For example, when the marker MA1 is set as the origin on the Xp-Yp plane, coordinates of each nozzle 151 of the printer 100 illustrated in FIG. 2 are determined, and coordinates of each pixel which is set as the print target ME0 are determined. Thereby, the relative position relationship between the printer 100 and the print target ME0 is specified.

In the display 16, MR display of superimposing the trimmed image IT0 on the print target ME0 can be realized by processing similar to S118 of FIG. 6. As illustrated in the scene 522 of FIG. 19, the relative position of the original print data DA0 with respect to the print target ME0 is set on the Xp-Yp plane of the printer coordinate system 310. Thus, the host device 10 may trim the original print data DA0 on the Xp-Yp plane in accordance with the facing shape of the print target ME0 as illustrated in the scene 523, convert the temporary print data DA2 on the Xp-Yp plane into print data in the camera coordinate system 300 as illustrated in the scene 524, and superimpose the obtained trimmed image IT0 on the captured image IM0.

The relative position relationship between the printer 100 and the print target ME0 can be specified without using a marker. For example, the printer 100 may have a plurality of feature points such as a plurality of corners and buttons 140. Thus, the host device 10 may obtain three-dimensional coordinate values of one or more feature points in the camera coordinate system 300 from the captured image IM0, and specify the relative position relationship between the printer 100 and the print target ME0 in the printer coordinate system 310 when a certain feature point is set as the origin. When four or more corners among eight corners of the printer 100, which includes a substantially rectangular parallelepiped casing 101, are extracted from one captured image IM0, the Zc-axis coordinate between the print target ME0 and the upper surface of the printer 100 can be obtained based on the extraction result. Thus, the host device 10 may specify the relative position relationship between the printer 100 and the print target ME0 in the printer coordinate system 310 when a certain feature point of the extracted feature points is set as the origin.

After specifying the relative position relationship, the host device 10 generates the print data DA1 by cutting the original print data DA0 in accordance with the facing shape of the print target ME0 in the three-dimensional printer coordinate system 310, the original print data DA0 being obtained based on the layout set with respect to the print target ME0 (S134). The print data DA1 includes a relative position relationship between the printer 100 and the print target ME0. For example, a coordinate value (Xp, Yp) on the Xp-Yp plane of the printer coordinate system 310 when the marker MA1 is set as the origin may include dot data indicating a dot formation state of each pixel. The dot data may be, for example, data indicating the presence or absence of a cyan ink dot, the presence or absence of a magenta ink dot, the presence or absence of a yellow ink dot, and the presence or absence of a black ink dot for each pixel. When the temporary print data DA2 is generated by trimming the original print data DA0 in accordance with the facing shape of the print target ME0 on the Xp-Yp plane of the printer coordinate system 310 in processing of S132, the host device 10 may generate the print data DA1 by adding information indicating the relative position relationship to the temporary print data DA2.

After generating the print data DA1, the host device 10 waits until there is a print request from the printer 100 (S136). For example, when the user slides the handheld printer 100 to a place at which the user wants to perform printing and presses the button 140, the printer 100 may transmit a print request as a print trigger to start printing at the corresponding print position, to the host device 10. The printer 100 illustrated in FIG. 2 calculates a coordinate value and a direction of the printer 100 on the Xp-Yp plane of the printer coordinate system 310 based on the movement direction and the movement distance detected by each movement amount detection sensor 130. Thus, the printer 100 may transmit the coordinate value and the direction of the printer 100 to the host device 10 together with the print request.

When receiving the print request, the host device 10 transmits data of a portion corresponding to the print position in the prepared print data DA1, to the printer 100 (S138). When receiving the coordinate value and the direction of the printer 100, the host device 10 generates partial dot data assigned to each nozzle 151 in consideration of the direction of the printer 100, and transmits the partial dot data to the printer 100. In addition, the host device 10 stores the mask information illustrated in FIG. 2 in the RAM 13 illustrated in FIG. 4, and assigns no-dot to a pixel for which a print completion flag FL1 is stored. When the printer 100 receives the partial dot data and is slid by an operation of the user, the printer 100 discharges ink droplets from the recording head 150 onto the print target ME0 according to the partial dot data.

The host device 10 repeats processing of S136 to S138 until printing is ended (S140), and ends the print control processing when printing is ended. By repeating processing of S136 to S140, as illustrated in FIG. 1, the print image IMp is formed in a portion of the print target ME0, at which the user slides the printer 100, and thus a printed matter is formed.

As described above, the host device 10 generates the print data DA1 corresponding to the specified print target ME0 by changing the original print data DA0 in accordance with the preview image IP0, and causes the printer 100 to perform printing on the print target ME0 based on the print data DA1. Further, the host device 10 modifies the original print data DA0 in accordance with the relative position which is set with respect to the print target ME0 such that the print target ME0 is included in the original print data DA0, and causes the printer 100 to perform printing on the print target ME0 based on the print data DA1 obtained by trimming the modified original print data DA0 in accordance with the facing shape of the print target ME0.

As described above, by performing the print target candidate extraction processing illustrated in FIG. 8, based on the captured image IM0 captured by the image capturing sensor 21 and the object distance of each pixel in the captured image IM0 measured by the distance measuring section 26, the area which is continuous in the predetermined range of colors is specified as the print target candidate A0, and any one of the print target candidates A0 is specified as the print target ME0. Thereby, an area which is not suitable for printing, such as a portion which is discontinuous in the depth direction, is excluded from the print target ME0. Therefore, according to the present specific example, usability can be improved.

Further, by performing MR display processing of the trimmed image IT0 in S112 to S118 illustrated in FIG. 6, the original print data DA0 larger than the print target ME0 is handled, and the preview image IP0 does not overlap with a portion protruding from the print target ME0. Thereby, the user can easily confirm an expected print result in a three-dimensional manner. Therefore, according to the present specific example, a more desired print result can be obtained.

4. MODIFICATION EXAMPLE

In the present disclosure, various modification examples are considered.

For example, the types of inks for forming an image on a print target may include light cyan having a lower density than cyan, light magenta having a lower density than magenta, white, and clear providing gloss, as well as cyan, magenta, yellow, and black. In addition, even when some of the inks of cyan, magenta, yellow, and black are not used, the present technique can be applied.

In addition, displaying after trimming is not limited to displaying only the inside of a document by deleting a portion protruding from the outside of the document. Displaying after trimming includes various display processing for allowing a user to recognize whether a portion is included in the inside or the outside of the document. For example, displaying after trimming includes changing a color or a density of a portion protruding from the outside of the document to a color or a density of the inside of the document, blinking the portion protruding from the outside of the document, and the like.

After extracting the print target candidate A0, the print target candidate A0 may be modified according to an instruction of a user, such as modification of the print target candidate A0 or integration of a plurality of print target candidates A0.

The above-described processing may be changed as appropriate, such as changing the order or performing the processing at the same time. For example, without performing processing of S214 illustrated in FIG. 8, the temporary print target candidate TA may be set as the print target candidate A0 regardless of the size. In addition, the temporary print target candidate TA may be directly set as the print target ME0 instead of the print target candidate A0.

FIG. 7 illustrates an example in which the host device 10 receives a print request for a range in which the print target ME0 is screened by the handheld printer 100 and transmits the print data DA1 divided into a plurality of pieces of data to the printer 100. On the other hand, the host device 10 may transmit all pieces of the print data DA1 to the printer 100 in advance. When all pieces of the print data DA1 are received, the printer 100 may sequentially generate partial dot data in which data of a portion of the print data DA1 corresponding to the print position is assigned to each nozzle 151, and discharge ink droplets from the recording head 150 onto the print target ME0 according to the partial dot data.

Processing of S202 to S216 of FIG. 8 illustrate an example in which the print target candidate A0 is set based on the captured image IM0 captured by the image capturing sensor 21 and the object distance of each pixel in the captured image IM0 measured by the distance measuring section 26. On the other hand, when the embodiment 11 is not performed, the print target candidate A0 may be set by another method.

For example, the host device 10 may extract a smooth surface such as a print target candidate A0, a table, a whiteboard, or the like from the captured image IM0 by using a depth of field and a plurality of focuses, and may extract a smooth surface such as a print target candidate A0 from the captured image IM0 by image recognition using artificial intelligence. Further, when the host device 10 includes a depth camera, the host device 10 may extract the print target candidate A0 or the like from the captured image IM0 by acquiring a Zc coordinate value of the camera coordinate system 300 from the depth camera. Further, the host device 10 may generate a histogram from a plurality of pixel values of the captured image IM0, and extract a print target candidate A0 or the like from the captured image IM0 based on the histogram. Further, the host device 10 may extract a print target candidate A0 or the like from the captured image IM0 by applying a filter or a mask to the captured image IM0. In these cases, the number of captured images IM0 for extracting the print target candidate A0 or the like may be one.

FIG. 21 illustrates an example in which the relative position relationship between the printer 100 and the print target ME0 is specified by image capturing of the printer 100 and the print target ME0. On the other hand, the relative position relationship between the printer 100 and the print target ME0 can be specified without capturing the printer 100. For example, the host device 10 may display, on the display 16, a screen in which an origin image indicating the origin is superimposed on the captured image IM0 including the print target ME0. In this case, the user who confirms the screen of the display 16 may perform an operation of placing the printer 100 at a position of the origin image and sliding the printer 100. Thus, the print data DA1 is printed on the print target ME0.

On the other hand, the print target candidate extraction processing of S102 of FIG. 6 is not limited to the print target candidate extraction processing illustrated in FIG. 8, and various processing may be performed.

Figure 22:
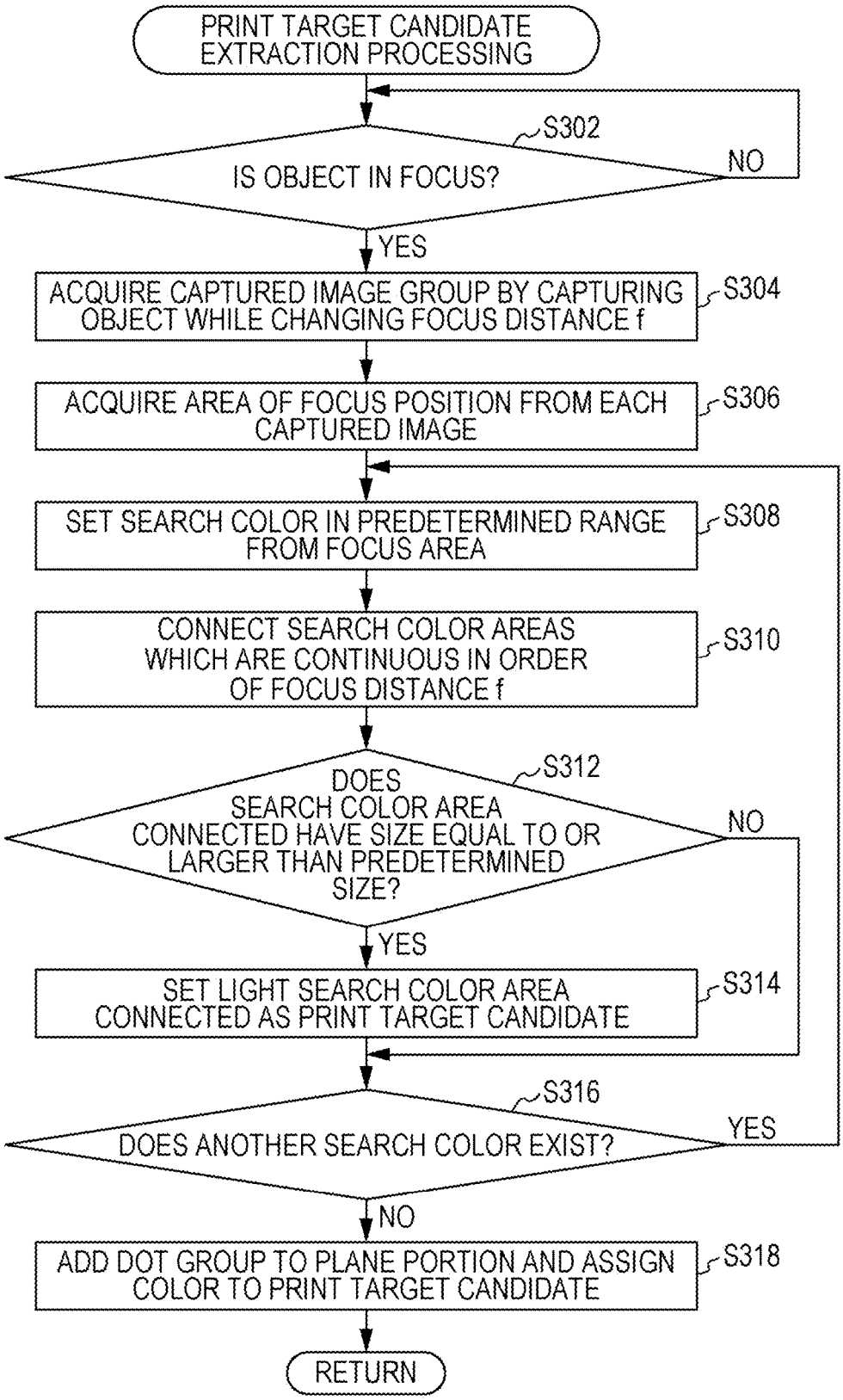
FIG. 22 is a flowchart schematically illustrating another example of print target candidate extraction processing performed by the print control device.
Figure 23:
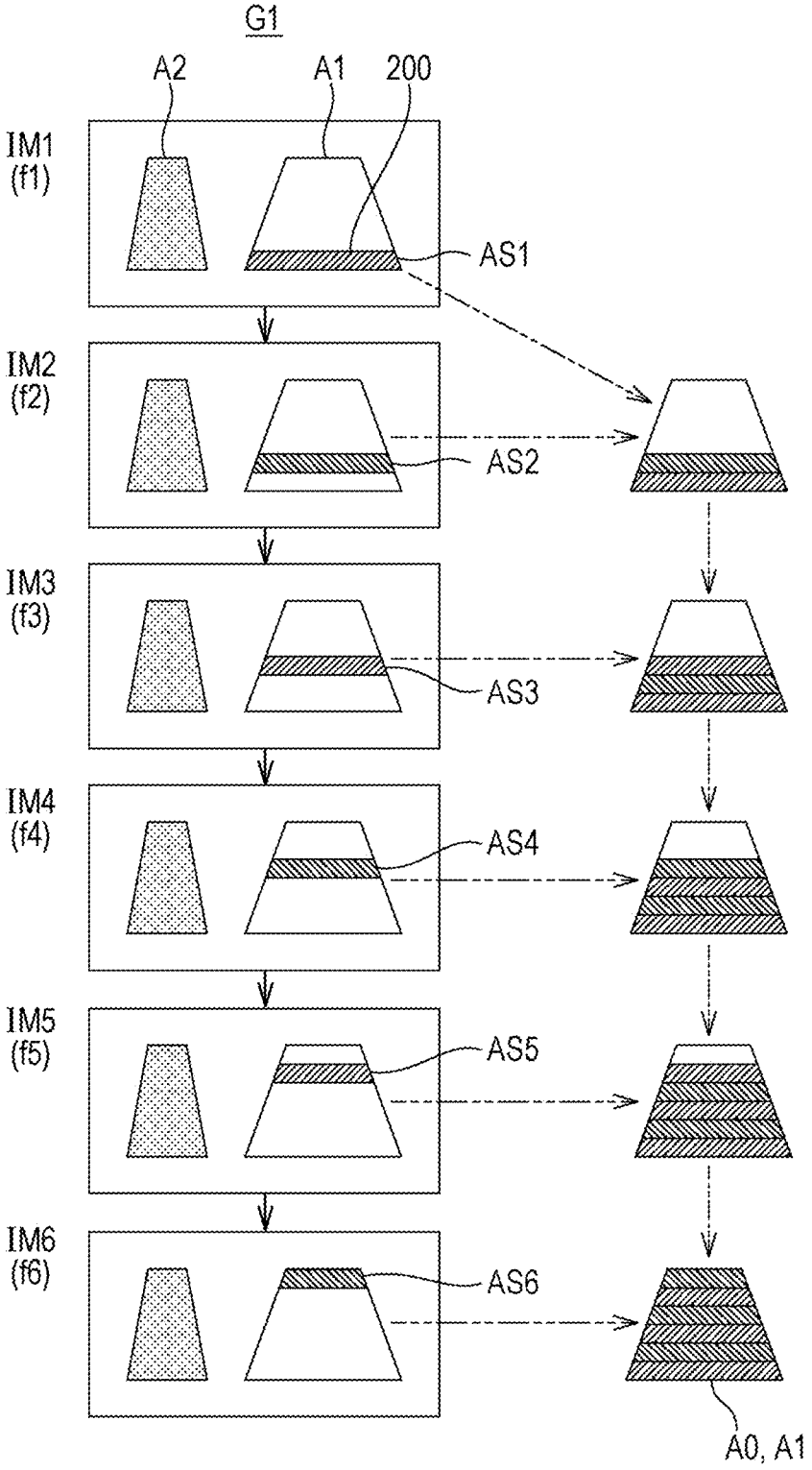
FIG. 23 is a diagram schematically illustrating an example of a print target candidate.

FIG. 22 schematically illustrates print target candidate extraction processing that may be performed in S102 of FIG. 6. Here, steps S302 to S316 correspond to the extraction section U11, the extraction function FU11, and the extraction step ST11. Step S318 and steps S112 to S114 and S118 of FIG. 6 correspond to the display section U2, the display function FU2, and the display step ST2. FIG. 23 schematically illustrates a state where the print target candidate A0 is extracted from a captured image group G1. It is assumed that the distance measuring section 26 illustrated in FIG. 4 detects a focus position 200 in focus from the image capturing range. The focus position 200 means a position at which the object is in focus. When the captured image IM0 is generated, the camera 20 stores information indicating the focus position 200 in the RAM 13 in association with the captured image IM0.

When the print target candidate extraction processing illustrated in FIG. 22 is started, the host device 10 operates the camera 20 when the camera 20 is not operated, and waits until the object is in focus when the object is not in focus (S302). It is assumed that objects are print target candidates A1 and A2 as illustrated in FIG. 9. When the object is in focus, the focus distance f is determined, and the object distance L is determined.

After confirming that the object is in focus, the host device 10 acquires a captured image group G1 by capturing the object by the image capturing sensor 21 while changing the focus distance f by the focus control section 27 (S304). At the focus distance f, the distance measuring section 26 measures the object distance L and detects the focus position 200. The host device 10 may perform capturing of the object while gradually increasing the focus distance f after decreasing the focus distance f determined in S302 by a predetermined distance, or may perform capturing of the object while gradually decreasing the focus distance f after increasing the focus distance f determined in S302 by a predetermined distance.

FIG. 23 schematically illustrates a state where the print target candidate A0 is extracted from a captured image group G1. The captured image group G1 illustrated in FIG. 23 includes captured images IM1 to IM6, which are still images captured while gradually increasing the focus distance f from f1 to f6. The captured images IM1 to IM6 include a print target candidate A1 having a first color in a predetermined range and a print target candidate A2 having a second color in a predetermined range. Here, the print target candidates A1 and A2 are areas extracted from the captured images IM1 to IM6, and it is not known whether or not the areas are print target candidates before performing the print target candidate extraction processing. Each of the captured images IM1 to IM6 is associated with a focus position 200 at which the print target candidates A1 and A2 are in focus with each of the focus distances f1 to f6. For convenience of description, only the focus position 200 of the first color is hatched in FIG. 23. In processing of S304 illustrated in FIG. 22, a captured image group G1 as illustrated in FIG. 23 is obtained.

After acquiring the captured image group G1, the host device 10 acquires an area of the focus position 200 from each captured image IM0 (S306). Here, the area of the focus position 200 will be referred to as a focus area. The focus areas are, for example, search color areas AS1 to AS6 illustrated in FIG. 23. Although not illustrated, a portion serving as the print target candidate A2 exists.

After acquiring the focus area, the host device 10 sets a search color in a predetermined range from the focus area (S308). When a first color and a second color different from each other exist in the focus area, the first color and the second color are sequentially set as search colors. In FIG. 23, in the captured image IM1 with the focus distance f1, the focus area of the search color as the first color is illustrated as the search color area AS1.

It is assumed that the print target candidate A0 has substantially the same light color. On the other hand, the print target candidate A0 does not necessarily have exactly the same color. Therefore, when the print target candidate has a color in a predetermined range when the color of the search color area AS1 is set as reference, it is determined that the search color areas AS2 to AS6 also have the first color. The predetermined range of the same color may be, for example, a range with a predetermined color difference when a color of the search color area AS1 is set as reference, may be a range with a predetermined luminance difference when a luminance value of the search color area AS1 is set as reference, or may be a range that falls within a predetermined rectangular parallelepiped when an RGB value of the search color area AS1 in an RGB color space is set as reference. When each pixel of the captured image IM0 is represented by an RGB value, as the luminance value, an arithmetic mean of a R value, a G value, and a B value, an average of the R value, the G value, and the B value with different weights, or the like may be used.

After setting the search color, the host device 10 performs processing of connecting the search color areas which are continuous in order of the focus distance f (S310). As illustrated in FIG. 23, it is assumed that the search color area AS2 corresponding to the focus position 200 of the first color included in the captured image IM2 with the focus distance f2 is searched. In FIG. 23, as illustrated on a right side of the captured image IM2, the host device 10 may perform processing of arranging the search color areas AS1 and AS2 on the same plane. When the search color areas AS1 and AS2 are connected to each other, the search color areas AS1 and AS2 are focus areas which are continuous in the first color. A case where the search color areas AS1 and AS2 are connected to each other includes a case where the search color area AS1 and the search color area AS2 partially overlap with each other on the same plane, and a case where the search color area AS1 and the search color area AS2 do not overlap with each other and there is no gap between the search color area AS1 and the search color area AS2.

Hereinafter, the search color area AS3 included in the captured image IM3 with the focus distance f3, the search color area AS4 included in the captured image IM4 with the focus distance f4, the search color area AS5 included in the captured image IM5 with the focus distance f5, and the search color area AS6 included in the captured image IM6 with the focus distance f6 are also arranged on the plane. The search color areas AS1 to AS6 are connected. The connected search color areas AS1 to AS6 are areas of smooth surfaces in which the focus positions 200 are continuous in the first color of a predetermined range in order of the focus distance f from the captured image group G1. Although not illustrated, a plurality of search color areas, in which the focus positions 200 are continuous in the second color of a predetermined range in order of the focus distance f from the captured image group G1, are also connected.

Figure 24:
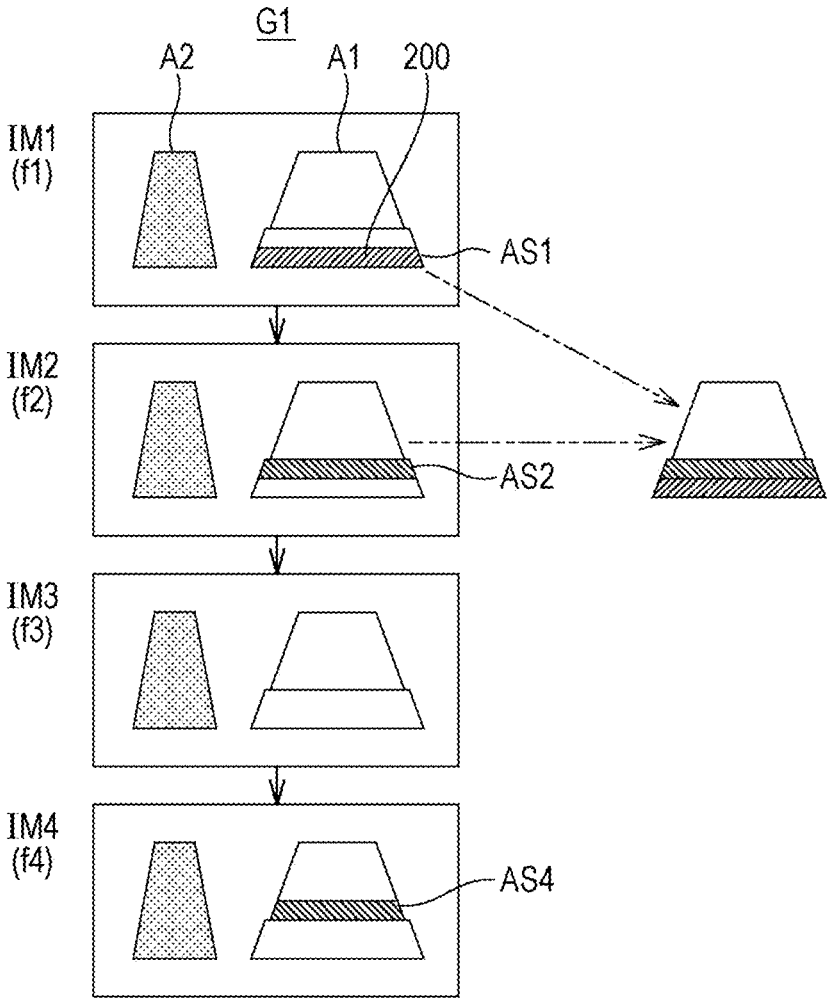
FIG. 24 is a diagram schematically illustrating an example of extracting a print target candidate from a captured image group.

The object includes a discontinuous portion in the depth direction such as a step portion in a uniform color area. FIG. 24 schematically illustrates how a search color area is extracted from the captured image group G1 when the object includes a step portion. In FIG. 24, the search color areas AS1 and AS2 having the first color are extracted from the captured images IM1 and IM2 in the same manner as in the example illustrated in FIG. 23. Here, when a step portion exists in the end of the search color area AS2, the search color area having the first color does not appear in the next captured image IM3. Therefore, even when the search color area AS4 having the first color appears in the next captured image IM4, in the search color areas AS2 and AS4, it cannot be said that the focus positions 200 are continuous in the first color of the predetermined range in order of the focus distance f.

After the connection processing of the search color areas, the host device 10 branches the processing depending on whether or not the connected search color area has a size equal to or larger than a predetermined size (S312). When the connected search color area has a size smaller than the predetermined size, the host device 10 does not set the connected search color area as a print target candidate, and the processing proceeds to S316. When the connected search color area has a size equal to or larger than the predetermined size, the host device 10 sets, as a print target candidate A0, a light search color area among the connected search color areas (S314), and the processing proceeds to S316. Since it is assumed that the print target candidate A0 has a light color, for example, the host device 10 may set, as the print target candidate A0, a search color area, which has a luminance value equal to or higher than a predetermined luminance value, among the connected search color areas. Among the connected search color areas having a size equal to or larger than a predetermined size, the search color area other than the print target candidate A0 is set as a smooth surface in the background of the print target candidate A0.

A coordinate of the connected search color area is converted to a coordinate on the Xp-Yp plane of the printer coordinate system 310, and then the size of the connected search color area is determined. The connected search color area on the Xp-Yp plane has a facing shape obtained based on the view angle θ1 of the captured image IM0 included in the captured image group G1. The host device 10 extracts, as the print target candidate A0, an area of a smooth surface in which the focus positions 200 are continuous in a predetermined range of colors in order of the focus distance f such that the area has a size equal to or larger than a predetermined size. The size of the connected search color area may be determined based on an area as illustrated in FIG. 14A, or may be determined based on a height which is a length in the Yp axis direction as illustrated in FIG. 14B.

As illustrated in FIG. 14A, it is assumed that a search color area having an area S1 larger than an area threshold value TS and a search color area having an area S2 smaller than the threshold value TS are extracted after connection processing. The search color area having the area S1>TS is set as a print target candidate A1 suitable for printing. The search color area having the area S2<TS is an area A9 which is not suitable for printing.

As illustrated in FIG. 14B, it is assumed that a search color area having a height H1 higher than a height threshold value TH and a search color area having a height H2 lower than the threshold value TH are extracted after connection processing. The search color area having the height H1>TH is set as a print target candidate A1 suitable for printing. The search color area having the height H2<TH is an area A9 which is not suitable for printing.

The host device 10 repeats processing of S308 to S314 until a search color to be set does not exist (S316). Thereby, the print target candidate A0, which has a size equal to or larger than a predetermined size and in which the focus positions 200 are continuous in a predetermined range of colors in order of the focus distance f from the captured image group G1, is extracted.

After extracting the print target candidate A0, as illustrated in FIG. 15, the host device 10 adds a dot group 400 to the plane portion of the captured image IM0 which is displayed, assigns a predetermined color to the print target candidate A0 (S318), and ends the print target candidate extraction processing.

As described above, by performing the print target candidate extraction processing illustrated in FIG. 22, the area, in which the focus positions 200 are continuous in a predetermined range of colors in order of the focus distance f from the captured image group G1, is specified as the print target candidate A0, and any one of the print target candidates A0 is specified as the print target ME0. Thereby, an area which is not suitable for printing, such as a portion which is discontinuous in the depth direction, is excluded from the print target ME0. Therefore, according to the present modification example, usability can be improved.

5. CONCLUSION

As described above, according to various embodiments of the present disclosure, it is possible to provide a technique capable of obtaining a more desired print result, a technique for improving usability of print control processing, and the like. Needless to say, the above-described basic operation and effect can be obtained even in a technique including only the components according to the independent claims.

In addition, a configuration in which the components disclosed in the examples are replaced with each other or a combination of the components is changed, a configuration in which the components disclosed in a known technique and the examples are replaced with each other or a combination of the components is changed, and the like may be applied. The present disclosure also includes these configurations and the like.

What is claimed is:

1. A print control device that causes a printing device to perform printing, the print control device comprising:

a specifying section that specifies a print target from a captured image captured by an image capturing sensor;

a display section that displays, on a display, a screen in which a trimmed image is superimposed on the captured image, the trimmed image being obtained by trimming a preview image of original print data in accordance with the print target;

a setting receiving section that receives a setting of a relative position of the preview image with respect to the print target;

a print instruction receiving section that receives a print instruction at the relative position; and a control section that causes the printing device to perform printing on the print target based on the original print data and the relative position according to the print instruction, the specifying section specifying the print target in a three-dimensional coordinate, and the display section displaying, on the display, the screen in which the trimmed image is superimposed on the captured image, the trimmed image being obtained by trimming the preview image in accordance with the print target based on the three-dimensional coordinate.

2. The print control device according to claim 1, wherein the control section causes the printing device to perform printing on the print target based on print data generated by performing trimming based on the three-dimensional coordinate.

3. The print control device according to claim 1, wherein the setting receiving section receives a setting of at least one of a size and a rotation angle of the preview image, as the relative position.

4. The print control device according to claim 1, wherein the display section performs modifying and trimming of the preview image in accordance with the print target, and displays, on the display, the screen in which the trimmed image is superimposed on the captured image, the trimmed image being modified and trimmed, and the control section causes the printing device to perform printing on the print target based on print data obtained by modifying the original print data in accordance with the preview image.

5. The print control device according to claim 1, further comprising:

a relative position specifying section that specifies a device position, which is a relative position relationship between the printing device and the print target included in the captured image, wherein the control section generates the print data based on the device position, and causes the printing device to perform printing on the print target based on the print data.

6. The print control device according to claim 1, wherein the printing device is a manual scanning type printer or an automatic scanning type printer.

7. The print control device according to claim 1, wherein the display section displays, on the display, the screen in which a dot group is added to a plane portion of the captured image.

8. A non-transitory computer-readable storage medium storing a print control program causing a printing device to perform printing, the program causing a computer to realize:

a specifying function of specifying a print target from a captured image captured by an image capturing sensor;

a display function of displaying, on a display, a screen in which a trimmed image is superimposed on the captured image, the trimmed image being obtained by trimming a preview image of original print data in accordance with the print target;

a setting receiving function of receiving a setting of a relative position of the preview image with respect to the print target;

a print instruction receiving function of receiving a print instruction at the relative position; and a control function of causing the printing device to perform printing on the print target based on the original print data and the relative position according to the print instruction, the specifying function specifying the print target in a three-dimensional coordinate, and the display function displaying, on the display, the screen in which the trimmed image is superimposed on the captured image, the trimmed image being obtained by trimming the preview image in accordance with the print target based on the three-dimensional coordinate.

9. A printed matter production method of producing a printed matter by a printing device, the method comprising:

a specifying step of specifying a print target from a captured image captured by an image capturing sensor;

a display step of displaying, on a display, a screen in which a trimmed image is superimposed on the captured image, the trimmed image being obtained by trimming a preview image of original print data in accordance with the print target;

a setting receiving step of receiving a setting of a relative position of the preview image with respect to the print target;

a print instruction receiving step of receiving a print instruction at the relative position; and a printing step of forming the printed matter by the printing device based on the original print data and the relative position according to the print instruction, the specifying step specifying the print target in a three-dimensional coordinate, and the display step displaying, on the display, the screen in which the trimmed image is superimposed on the captured image, the trimmed image being obtained by trimming the preview image in accordance with the print target based on the three-dimensional coordinate.

* * * * *